US007392920B2

(12) United States Patent
Dedo

(10) Patent No.: US 7,392,920 B2
(45) Date of Patent: Jul. 1, 2008

(54) COLLAR HOLDING DEVICE

(76) Inventor: Richard G. Dedo, 175 Denise Dr., Hillsborough, CA (US) 94010

( * ) Notice: Subject to any disclaimer, the term of this patent is extended or adjusted under 35 U.S.C. 154(b) by 0 days.

(21) Appl. No.: 11/760,135

(22) Filed: Jun. 8, 2007

(65) Prior Publication Data

US 2008/0040903 A1 Feb. 21, 2008

Related U.S. Application Data

(62) Division of application No. 10/920,511, filed on Aug. 18, 2004, now Pat. No. 7,328,821.

(51) Int. Cl.
*A41D 27/22* (2006.01)

(52) U.S. Cl. ..... 223/85

(58) Field of Classification Search ..... 223/85–98; 24/545

See application file for complete search history.

(56) References Cited

U.S. PATENT DOCUMENTS

| | | | |
|---|---|---|---|
| 1,201,195 | A | 10/1916 | Kinsinger, Sr. |
| 1,434,712 | A | 11/1922 | Launder |
| 2,022,401 | A | 11/1935 | Brooks et al. |
| 2,147,590 | A | 2/1939 | Adkins |
| 2,171,301 | A | 8/1939 | Christensen et al. |
| 2,468,477 | A | 4/1949 | Zimmerman |
| 2,569,152 | A | 9/1951 | Collins |
| 2,609,976 | A | 9/1952 | Burk et al. |
| 2,649,229 | A | 8/1953 | Sutter |
| 2,723,765 | A | 11/1955 | Meredith |
| 2,738,112 | A | 3/1956 | Miller |
| 2,750,087 | A | 6/1956 | Antal |
| 2,861,726 | A | 11/1958 | Whyte |
| 2,864,540 | A | 12/1958 | Kass |
| 2,880,928 | A | 4/1959 | Merrill |
| 3,085,725 | A | 4/1963 | Caparosa |
| 3,456,853 | A | 7/1969 | Hodge |
| 3,865,286 | A | 2/1975 | Tiss |
| 4,669,642 | A | 6/1987 | Nicholas |
| 5,360,148 | A | 11/1994 | Goscin et al. |
| 5,575,410 | A | 11/1996 | Compton |
| 5,605,261 | A | 2/1997 | Berglund |
| 5,769,287 | A | 6/1998 | Kim |
| 5,769,288 | A | 6/1998 | Berglund |
| 5,940,882 | A | 8/1999 | Auguste |
| 6,089,422 | A | 7/2000 | Gibson |
| 6,105,166 | A | 8/2000 | Thomas, III et al. |
| 6,105,833 | A | 8/2000 | Najarian |
| 6,240,559 | B1 | 6/2001 | Cares |
| 6,250,116 | B1 | 6/2001 | Groshens |
| 6,269,989 | B1 | 8/2001 | Kiselik |
| 6,644,521 | B1 | 11/2003 | Tiss et al. |

FOREIGN PATENT DOCUMENTS

| | | | |
|---|---|---|---|
| EP | 97396 | A1 * | 1/1984 |

* cited by examiner

*Primary Examiner*—Shaun R Hurley
(74) *Attorney, Agent, or Firm*—Whyte Hirschboeck Dudek SC

(57) ABSTRACT

A device for holding a collar of a garment on a hanger, blanks for manufacturing the collar holding device, methods of using the collar holding device in hanging a collared garment on a hanger, and the collar holding device in combination with a hanger and a hangered garment are provided. The collar holders of the invention tightly pull a collar mounted on the collar holder together in an overlapping arrangement to maintain a wrinkleless shirtfront.

20 Claims, 23 Drawing Sheets

FIG. 2F
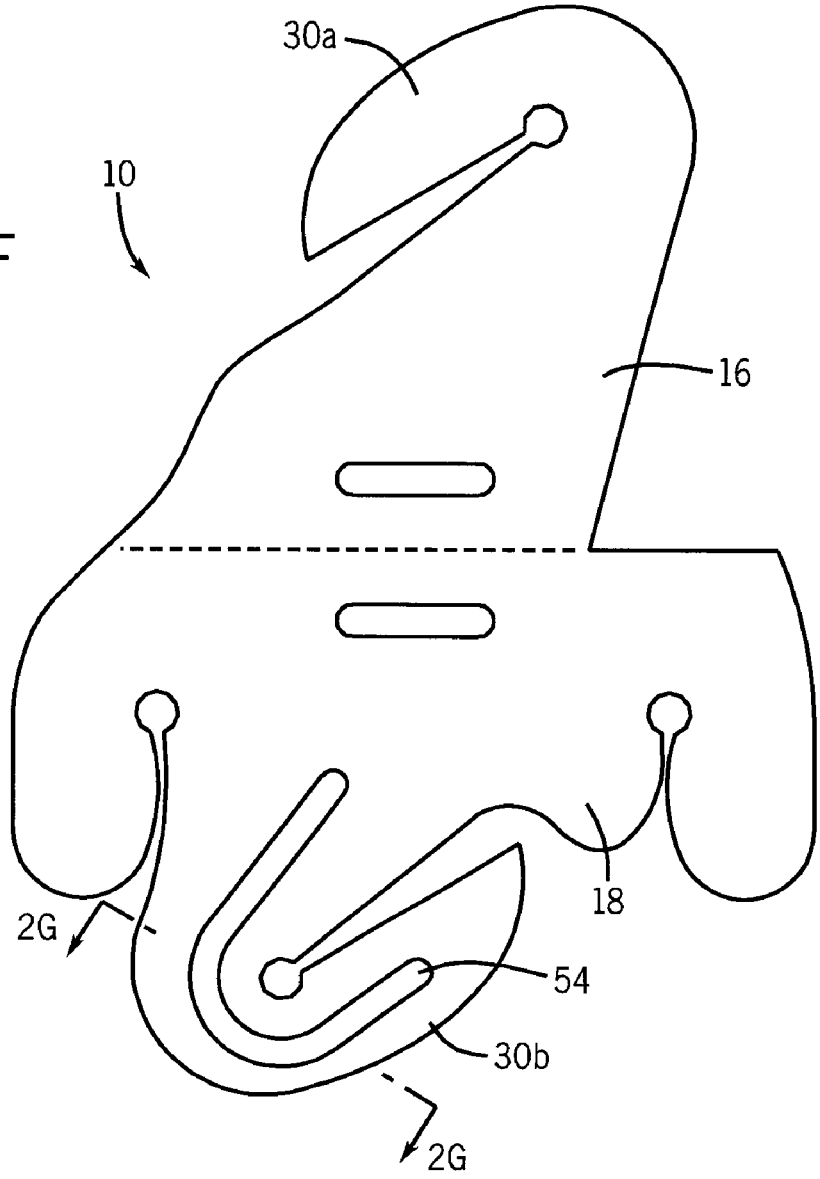
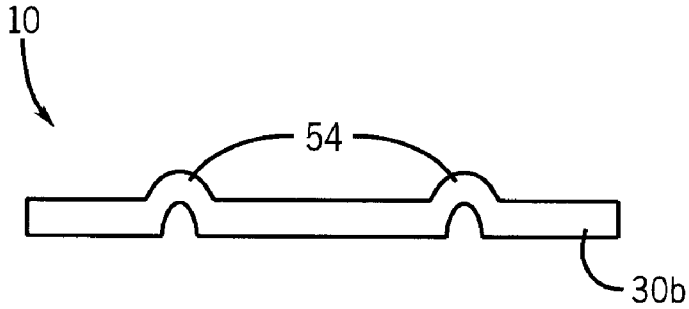
FIG. 2G

COLLAR HOLDING DEVICE

CROSS REFERENCE TO RELATED APPLICATION

This application is a divisional of U.S. patent application Ser. No. 10/920,511, filed Aug. 18, 2004 now U.S. Pat. No. 7,328,821.

FIELD OF THE INVENTION

The invention relates to supporting the collar of a hangered garment, and more particularly to a device that can be hung on a garment hanger to retain a garment in a desired configuration after laundering.

BACKGROUND OF THE INVENTION

A goal of laundries is to maintain freshly laundered and pressed shirts in an unwrinkled condition until returned to the customer. However, a hanger supports only the shoulder portions of a shirt. As a result, the collar tends to sag causing the upper part of the front plackets to pucker and open and unsightly wrinkling down the front of the shirt.

Various techniques have been ineffectually used with a hangered shirt in an attempt to maintain a pressed appearance and avoid creases and wrinkles. For example, pins, clips, and staples have been attached to the collar of a shirt to prevent the shirt from opening or falling off a hanger. A drawback of such devices is that they can rust or leave holes in a shirt. Another drawback is that the devices do not support the collar in a position that precludes the formation of wrinkles, and do not overlap the sides of the front of the shirt.

A variety of collar supports have also been described. One such device involves a collar attachment adhesively attached along the neckband of a shirt under the collar and a lower portion adhesively attached to the upper portion of the front placket to support the collar attachment and hold the collar in place. Another device is made of a strip of flexible material formed into a cylindrical shape and hung on a hanger to support the collar of a shirt. Other cardboard pieces have been described for use as collar stays or shaping pieces.

Such devices do not adequately prevent wrinkling of the collar or the front portion of a hangered shirt. In addition, most known devices for supporting hangered shirt collars are too complicated to construct and use, and/or susceptible to easy dislodgment and not likely to stay in place or provide the necessary support to the shirt.

It would be desirable to develop a device for supporting the collar of a hangered shirt or other garment that overcomes such drawbacks.

SUMMARY OF THE INVENTION

The present invention relates to a collar holding device for use with a hangered shirt or other garment having a collar. The collar holder can be mounted on a conventional garment hanger having a hook and laterally extending shoulder supports.

In one aspect, the invention provides a collar holder. In general, the collar holder includes an element for mounting on a garment hanger, and two extension elements that are integral with the mounting element and structured to be placed under flaps of an unbuttoned collar of a garment hung on the garment hanger such that the ends of the collar flaps are maintained in an overlapping relationship and the front plackets of the garment are maintained in an overlapping and parallel relationship to each other.

In one embodiment the collar holder comprises an overlying top panel and base panel that are hung over the hook of a hanger. Each panel includes a base end having an aperture and a distal end comprising a (finger) extension member. When the top panel is disposed over the base panel with the apertures aligned, the extension members are oriented in opposite diagonal directions. The aperture is sized for receiving a hook of a garment hanger therethrough. Typically, the top and base panels comprise a stiff yieldably flexible material such as cardboard. Optionally, a reinforcing element such as a stiff yet flexible wire or a strip of cardboard, plastic or other stiff material, can be adhered to or incorporated into the panels and/or extension members of the collar holder for additional strength and stiffness.

In another embodiment, the top and base panels are foldably connected along a foldline, which can be situated, for example, along a length of the base ends or along the side edges. In a preferred embodiment, at least one of the panels includes a pair of side flaps integrally attached along the sides of the base end of the panel. The side flaps are adapted for engagement with the shoulder supports of the garment hanger for securing the collar holder in a substantially fixed or stationary position. Optionally, a surface of the side flaps can include a layer of an adhesive material such as a pressure sensitive adhesive to assist in attaching the side flaps to the hanger.

The extension members are adapted (sized and dimensioned) for engagement under the collar wings of a collar of an unbuttoned garment mounted on a hanger with the collar wings overlapped in a generally "V" configuration, and the front plackets of the garment overlapped and hung in a substantially parallel alignment.

The collar holder can also be structured such that it can be attached at varying heights on a hanger. Rather than having a single hole or aperture in the base end of the panels, in one embodiment, the panel can be structured with a series of vertically positioned openings, slots or slits, such that the collar holder can be positioned at different heights relative to the upper part of the hanger. This feature allows for placement of the collar holder on a hanger to achieve maximum support of the collar and the shirt and the elimination of gaps and creases.

In use with a shirt or other collared garment that is hung on a garment hanger, the collar holder of the invention provides support to the collar so that the front plackets do not gap or pucker and there is substantially no creasing, crumpling or wrinkling of the front plackets or front of the garment.

In another aspect, the invention provides a blank for forming a collar holder for a garment collar. In one embodiment, the blank comprises a top panel and base panel, each panel comprising a base end having an aperture and a distal end comprising an extension member, such that when the distal end of the top panel is placed over the distal end of the base panel and the apertures are aligned, the extension members are oriented in opposite diagonal directions. In a preferred embodiment, at least one of the panels of the blank comprises a pair of side flaps integrally attached to the base end. Optionally, a surface of the side flaps can be coated with a pressure sensitive adhesive, for example.

In another embodiment, the blank is a unitary blank comprising top and base panels that are foldably connected along a foldline. When the top panel is folded onto the base panel, the apertures are aligned and the extension members are oriented in opposing diagonal directions. The foldable connection can be along a length of the base ends or along a side edge.

In another embodiment, a unitary blank comprises a top panel foldably connected to a base panel, each of the top and base panels including an aperture in the base end, and a distal end comprising an extension member defined by a slot extending inwardly at an angle from one side edge toward the distal end. When the top panel is folded onto the base panel, the apertures are aligned to form a common aperture, and the extension members of the top and base panels are oriented in opposing diagonal directions.

In another aspect, the invention provides the combination of the collar holder of the invention mounted onto a garment hanger. In one embodiment, the hook end of the garment hanger is inserted through a common aperture of the collar holder, and, where side flaps are employed, the side flaps are engaged with (e.g., straddle) the lateral extensions of the hanger to secure the collar holder in a substantially and generally fixed or stationary position. Generally, the side flaps and the top and base panels of the collar holder are mounted on the hanger such that they straddle the lateral extensions on opposite sides, with the side flaps positioned behind the lateral extensions and the top and base panels positioned in front of the lateral extensions. The side flaps can also be folded around the lateral extensions and secured together with staples, adhesive, or other securing means.

In another embodiment, the collar holder is fabricated from wire or other resilient material, and mounted on or attached to a garment hanger. The wire version of the collar holder is bent to include angled segments that are inserted under the collar. The wire collar holder can be hung or mounted directly onto a hanger, or a hanger can be fabricated to incorporate the collar holder as an integral part.

In yet another aspect, the invention provides the combination of a collared garment affixed to the collar holder of the invention mounted on a garment hanger, which is generally composed of lateral extensions to support the garment and a central hook extending from the lateral extensions. In one embodiment, the hook end of the garment hanger is disposed through the apertures of the collar holder and, if employed, the side flaps of the collar holder are engaged with the lateral extensions of the garment hanger. A collared garment (e.g., a shirt) is mounted on the garment hanger with the extension members of the collar holder disposed under the collar wings at each end of the collar such that the collar wings are overlapped in a "V" arrangement and the front plackets of the garment hang in a substantially parallel alignment.

A further aspect of the invention is a method of using the collar holder to hang a collar of a garment on a hanger such that the front of the garment is substantially smooth with few or no wrinkles or creases. In one embodiment, the method comprises the steps of mounting a collar holder according to the invention onto a garment hanger, for example, by inserting the hook end of the garment hanger through the apertures (or loop) of the collar holder, or otherwise attaching the collar holder to the hanger, mounting the garment on the garment hanger and over the collar holder, and positioning the extension members of the collar holder under the collar wings of the collar such that the collar wings are overlapped in a "V" arrangement and the front plackets of the garment are overlapped and hang in a substantially parallel alignment.

In another embodiment of a method of hanging a collared garment on a hanger, the method employs a collar holder having side flaps on at least one of the panels, and comprises the steps of mounting the collar holder onto a garment hanger by inserting the hook of the hanger through the apertures and engaging the side flaps of the collar holder with the lateral extensions of the garment hanger such that the collar holder in secured on the garment hanger in a generally stationary position, mounting the garment on the garment hanger and over the collar holder, and inserting the extension members of the collar holder under the collar wings along the neck line of the collar, the collar wings being overlapped in a "V" layout and the front of the garment held up with the front plackets substantially parallel. Optionally, if desired, the side flaps can be secured around the lateral extensions, for example, by folding the ends of the flap up and around the lateral extensions and fastening the ends together with adhesive, for example.

Use of the present collar holder results in a substantial reduction in the amount of creasing and wrinkling of the front of a hung garment, particularly along the shoulders at the neck, and the upper section of the front plackets below the neck line and at about the top button. The present device also eliminates the need to button a garment on the hanger resulting in savings of time, labor, and cost. The present collar holder of the invention can be conveniently shipped, for example, in the form of flat blanks, to end users such as retailers, laundries, and the like, and the collar holders can be simply and easily mounted onto garment hangers at the point of use. Another advantage is that when a shirt is stored (e.g., hung in a closet) with the collar holding device in place and compressed between adjacent garments, the device inhibits wrinkles from being set into the fabric in the front of the shirt or other garment.

BRIEF DESCRIPTION OF THE DRAWINGS

Preferred embodiments of the invention are described below with reference to the following accompanying drawings, which are for illustrative purposes only. Throughout the following views, the reference numerals will be used in the drawings, and the same reference numerals will be used throughout the several views and in the description to indicate the same or like parts.

FIG. 2F is a plan view of another embodiment of a reinforcing element of the FIG. 2C blank. FIG. 2G is a side elevational view of the blank of FIG. 2F taken along line 2F-2F.

FIG. 23 depicts the collar holder in a plan view.

FIG. 24 shows the collar holder of FIG. 23 in a side elevational view, as viewed along line 20-20.

FIG. 25 depicts the collar holder of FIG. 23 mounted on a hanger by means of a loop.

FIG. 26 depicts the collar holder of FIG. 23 mounted on a hanger by joining an end of the holder to the base portion of the hook of the hanger.

FIGS. 27-28 illustrate a shirt collar mounted on the collar holder of FIG. 23.

DETAILED DESCRIPTION OF THE INVENTION

The invention will be described generally with reference to the drawings for the purpose of illustrating the present preferred embodiments only and not for purposes of limiting the same.

In some embodiments, the collar holding device is composed of two overlying panels, each with an extension member for placement under the wings of an unbuttoned collar along the neck line such that the collar wings are overlapped and secured at an angle with the front of the garment held upward to eliminate wrinkles along the front plackets and at the neck line. In other embodiments, the collar holder is composed of wire that is hung from or integral to a garment hanger, and bent and configured to provide extension members that are positioned under the collar.

Figure 1:
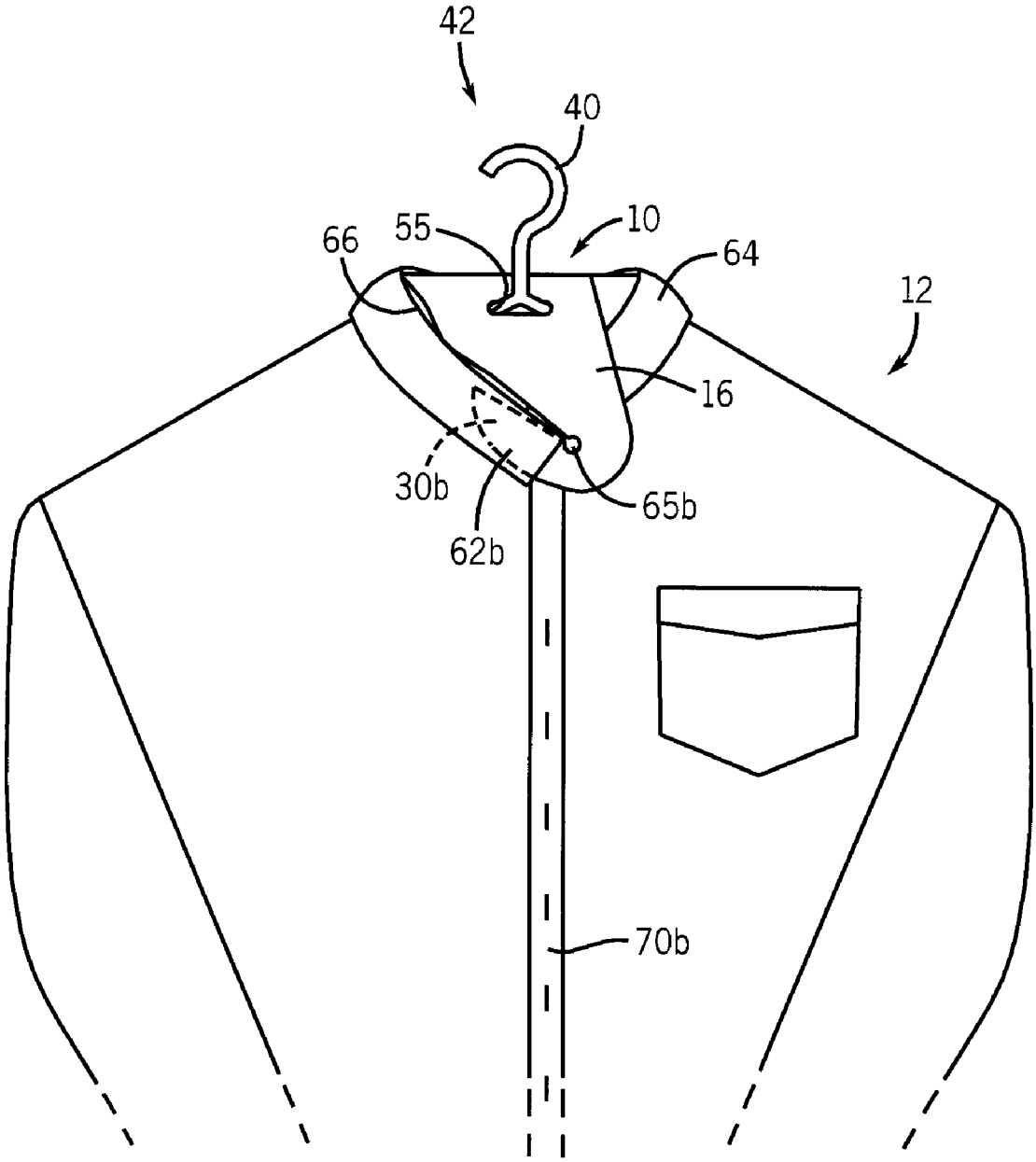
FIG. 1 is perspective front view of a shirt hanging on a conventional wire garment hanger with the collar being supported by a collar holder according to the invention.

An embodiment of a collar holding device 10 according to the invention is illustrated in FIG. 1, as it is used with a hangered shirt 12. As shown, the collar holding device is designed for engaging the ends of a collar of an unbuttoned hangered shirt or other garment in a folded arrangement.

Referring to FIGS. 2-5, the collar holding device 10 is formed from a blank 14 of a flat piece of material such as cardboard, paperboard, fiberboard, plastic, or other stiff or semi-rigid yet yieldably flexible material. The blank can have a non-skid surface or include non-skid strips to minimize slippage of the collar off the collar holder. The blank can be cut or stamped to a desired size to accommodate different garment and collar sizes.

As shown, the blank 14 for the collar holding device 10 includes a top portion or panel 16 foldably connected to a base portion or panel 18 along a foldline 20. Top panel 16 includes opposing first side edge 22*a* and second side edge 24*a*, a base end 26*a*, and a distal end 28*a*. Base panel 18 includes opposing first side edge 22*b* and second side edge 24*b*, a base end 26*b*, and a distal end 28*b*.

Each of the distal ends 28*a*, 28*b* of the panels 16, 18 includes a hook- or finger-like projection or extension member or element 30*a*, 30*b* defined by an angled slit or slot 32*a*, 32*b*. In the top panel 16, the slot 32*a* extends at an angle from the first side edge 22*a* inwardly toward the distal end 28*a* resulting in a finger-like projection 30*a* in the distal end 28*a* of the panel 16. In the base panel 18, the slot 32*b* extends at an angle from the second edge 24*b* inwardly toward the distal end 28*b* to form a similar finger-like projection 30*b*. As illustrated in the blank 14, the angled slots are oriented in the same direction (arrow 34) such that, when the panels 16, 18 are folded onto each other along the foldline 20, the ends 36*a*, 36*b* of the extension members 30*a*, 30*b* will be pointed or oriented in opposite diagonal directions (to engage both ends of a collar of a shirt). Preferably, the ends 37*a*, 37*b* of the slots 32*a*, 32*b* are rounded to facilitate mounting the collar of a shirt or other garment on the device, and to make the device more resistant to tearing when fabricated from a tear-able material.

Each of the panels 16, 18 include an aperture 38*a*, 38*b* in the base end 26*a*, 26*b* proximal to the foldline 20. The apertures 38*a*, 38*b* can be cut or punched through the material and are sized for receiving the hook 40 of a garment hanger 42 therethrough, as shown in FIG. 1. The apertures 38*a*, 38*b* can be a slot, a slit, circular, or other shaped hole or opening. The apertures are positioned in the base ends 26*a*, 26*b* such that the apertures are aligned when the top panel 16 is folded onto the base panel 18. Preferably, the apertures 38*a*, 38*b* are positioned in about the center of the base ends of the panels.

In a preferred embodiment, the base panel 18 includes a pair of side extensions or flaps 44*a*, 44*b* that are integrally connected to the base end 26*b*. The side flaps 44*a*, 44*b* are defined by a slot 46*a*, 46*b* extending from the side edges 22*b*, 24*b* and into the base end 26*b* toward the foldline 20. The side flaps 44*a*, 44 *b* are sized and adapted for engaging the laterally extending shoulder supports ("lateral extensions") 48*a*, 48*b* of a garment hanger 42 (FIG. 3) to secure the collar holder 10 onto the hanger, preferably in a substantially fixed position. Preferably, the ends of 49*a*, 49*b* of the slots 46*a*, 46*b* are rounded to facilitate mounting of the slide flaps on the lateral extensions of the hanger and to avoid tearing of the device made of a tear-able material.

Figure 2:
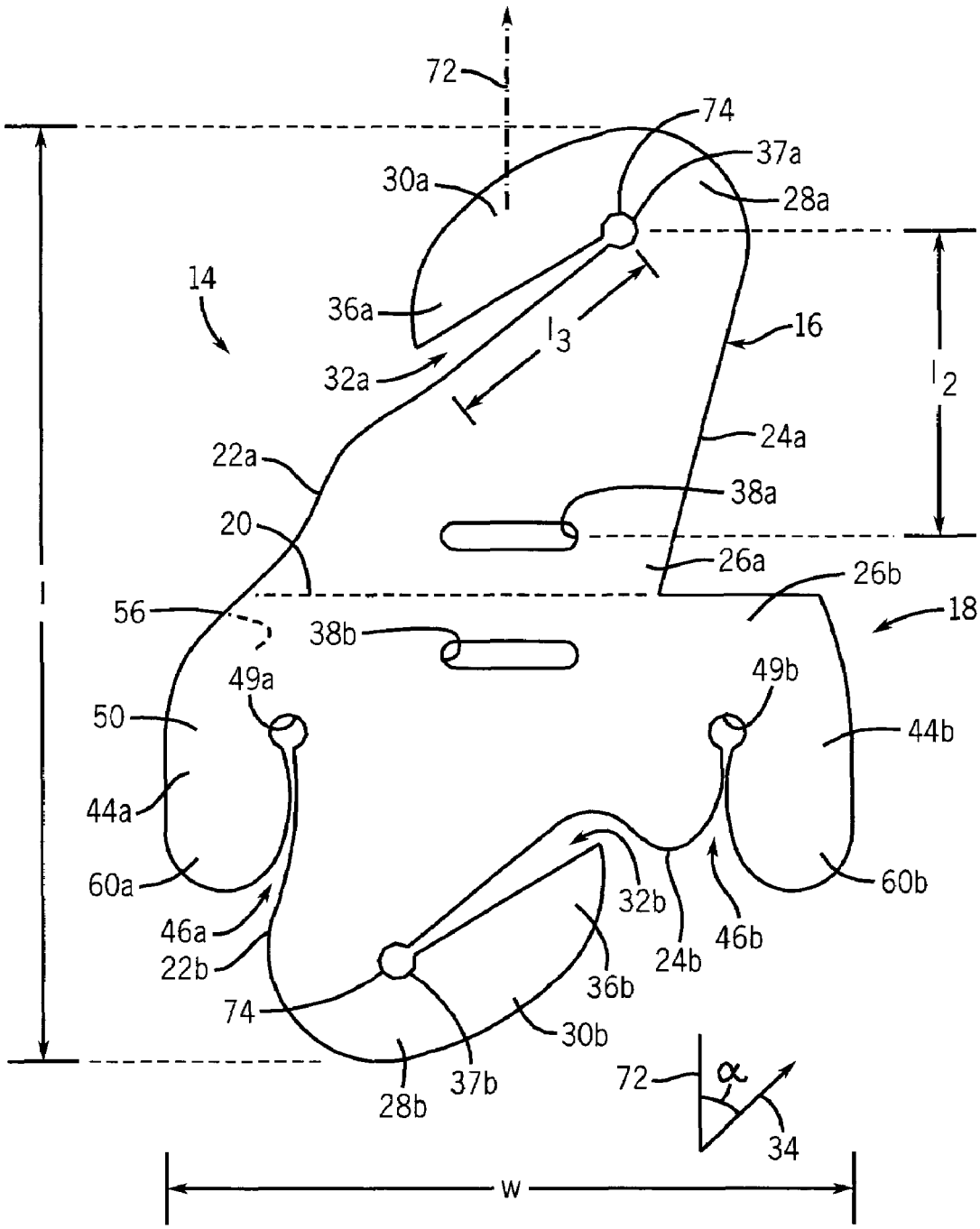
FIG. 2 is a plan view of an integral blank used to form a first embodiment of a collar holder according to the invention.
Figure 2A:
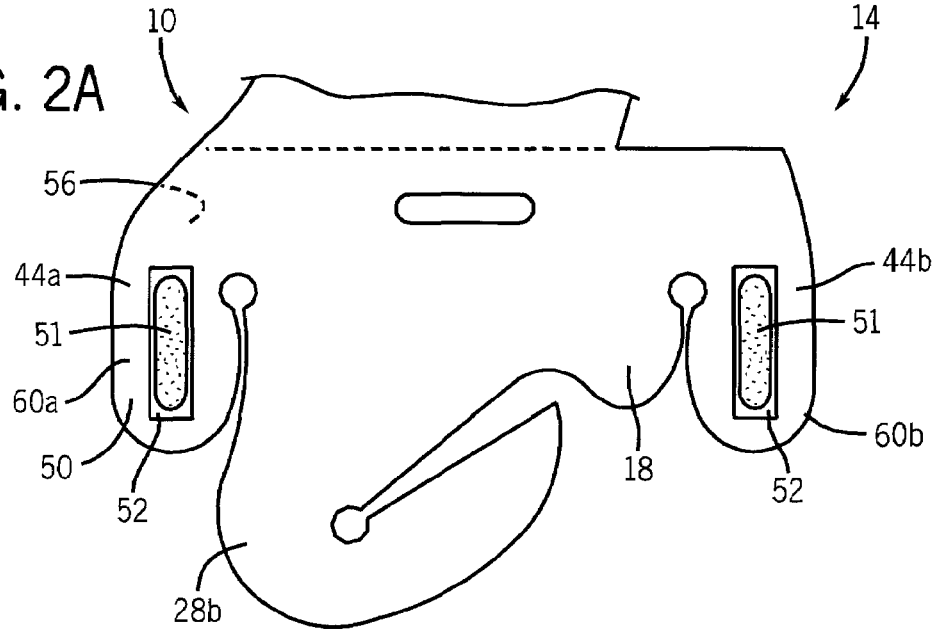
FIG. 2A is a partial plan view of an embodiment of the FIG. 2 blank having adhesive areas disposed on a front surface of the side flaps.

Optionally, as in the embodiment depicted in FIG. 2A, an adhesive such as a pressure sensitive adhesive can be applied on the front surface 50 of the side flaps 44*a*, 44*b* in a region 51. The adhesive region 51 can be covered with a peel-off protective backing 52.

Figure 2B:
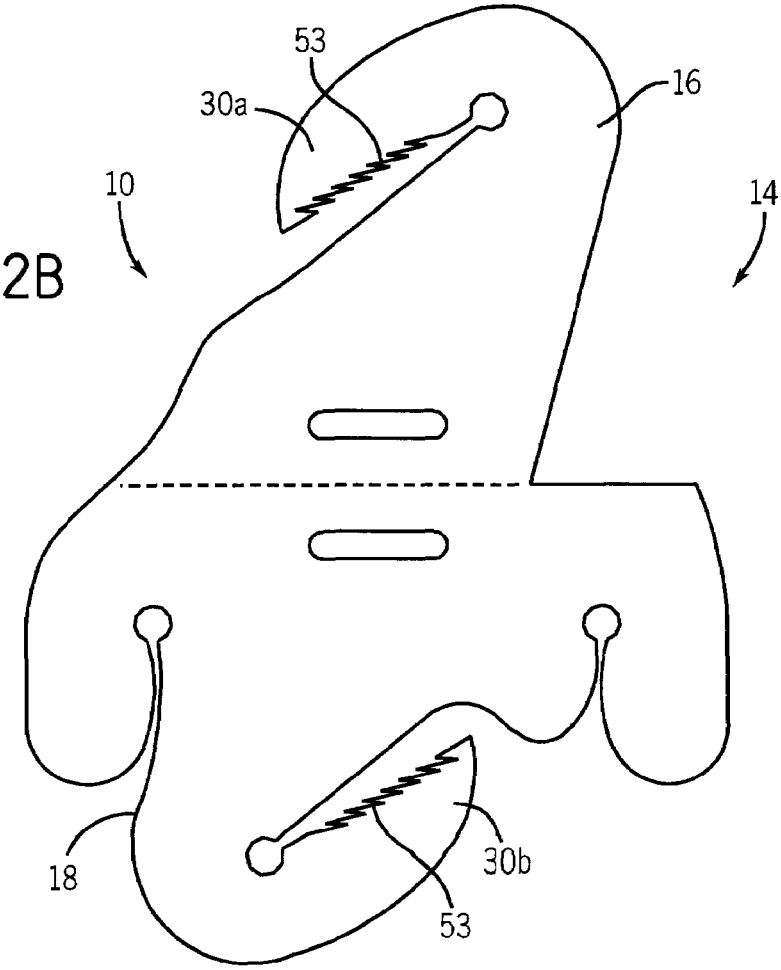
FIG. 2B is a partial plan view of an embodiment of the FIG. 2 blank with the (finger) extension members having a serrated edge.
Figure 2C:
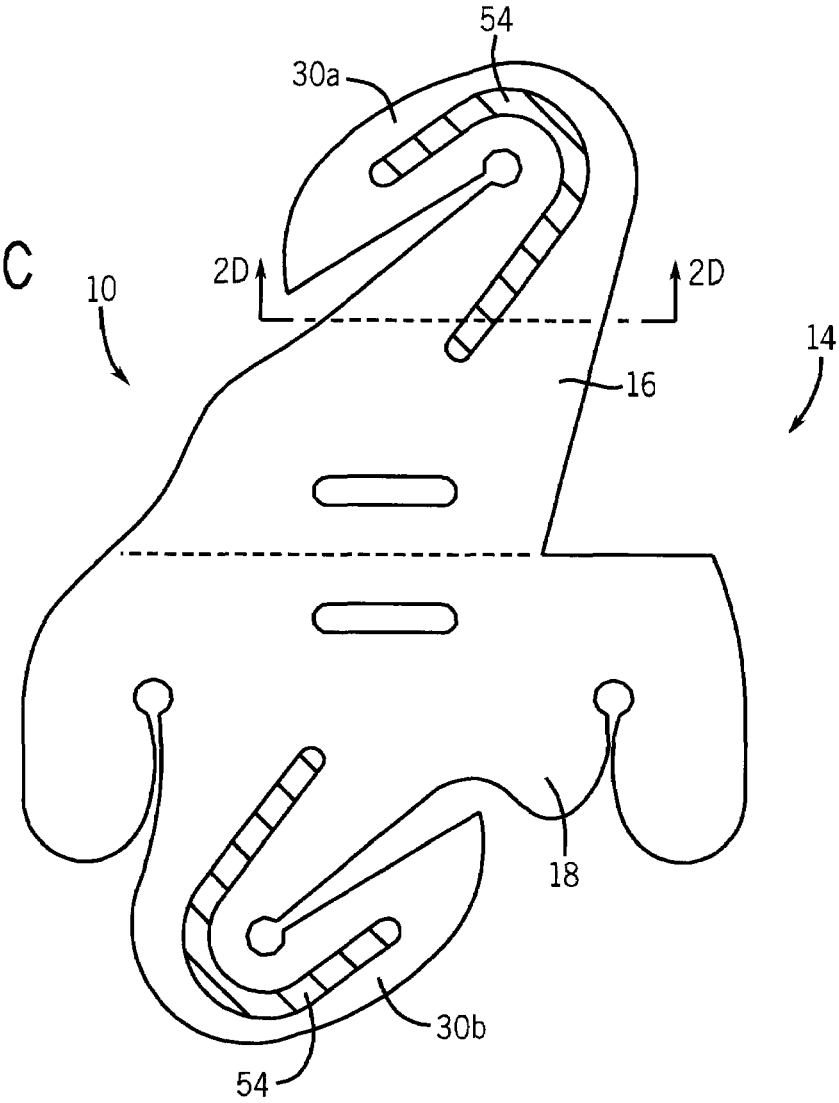
FIG. 2C is a plan view of an embodiment of the FIG. 2 blank having a reinforcing element.
Figure 2D:
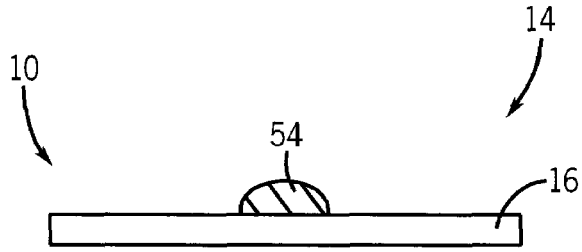
FIG. 2D is a side elevational view of the blank of FIG. 2C taken along line 2D-2D.

In another embodiment of a collar holder 10 and blank 14 shown in FIG. 2B, the extension members 30*a*, 30*b* can include a serrated edge 53 to provide a frictional surface against the garment material to keep the collar wings in position, and prevent them from slipping out of the holder.

Figure 2E:
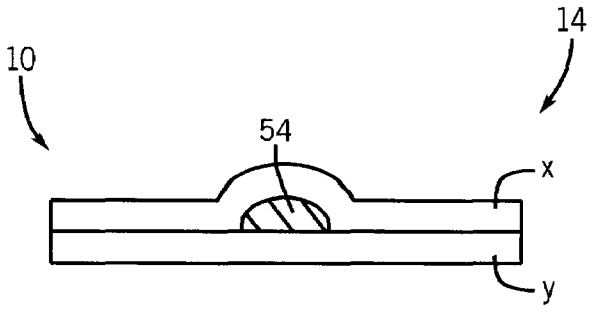
FIG. 2E is a side elevational view of the blank of FIG. 2C that has been modified as a composite with the reinforcing element between two material layers, taken along line 2D-2D.

As another option, as shown in FIGS. 2C-2F, the collar holder 10 (and blank 14) can include a reinforcing element 54 to strengthen the panels 16, 18 and/or the extension members 30*a*, 30*b*. The reinforcing element 54 can be a stiff or rigid material, for example, wire, cardboard, paperboard, fiberboard, or plastic, among others, and can be attached to one or both surfaces of the panels and/or flaps (shown as attached to one surface in FIG. 2D), or sandwiched inbetween two material layers x, y that constitute the collar holder 10 (FIG. 2E). The reinforcing element 54 can be provided as a continuous or discontinuous pattern, and can be attached to the panel(s) and/or flap(s), for example, using an adhesive. The reinforcing element is preferably provided as a raised section of the panels 16, 18 and/or the extension members 30*a*, 30*b*, for example, a raised impression (or depression) of the material used to form the extension member 30*b*, as shown in FIGS. 2F-2G.

Figure 3:
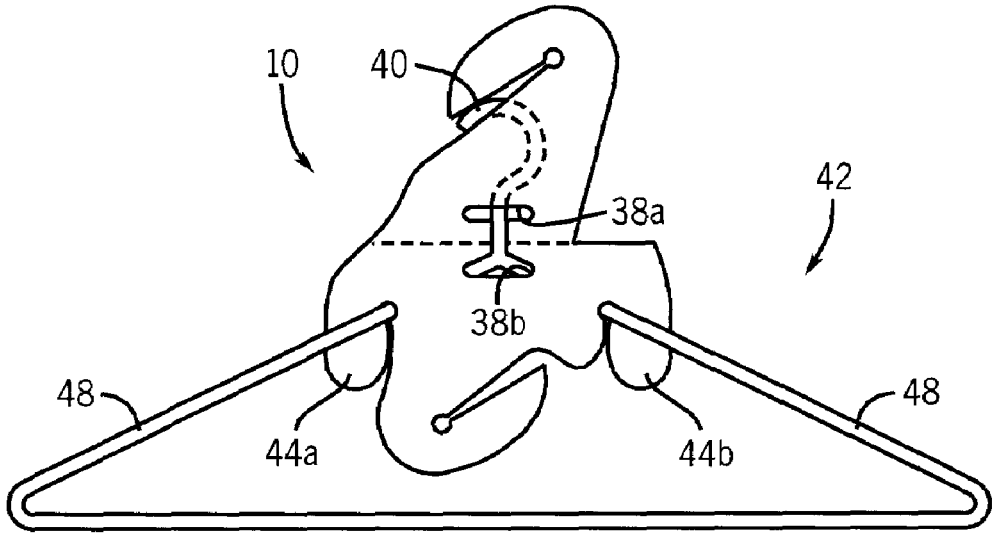
FIG. 3 is a perspective front view of a collar holder formed from the FIG. 2 blank being mounted on a garment hanger.
Figure 4:
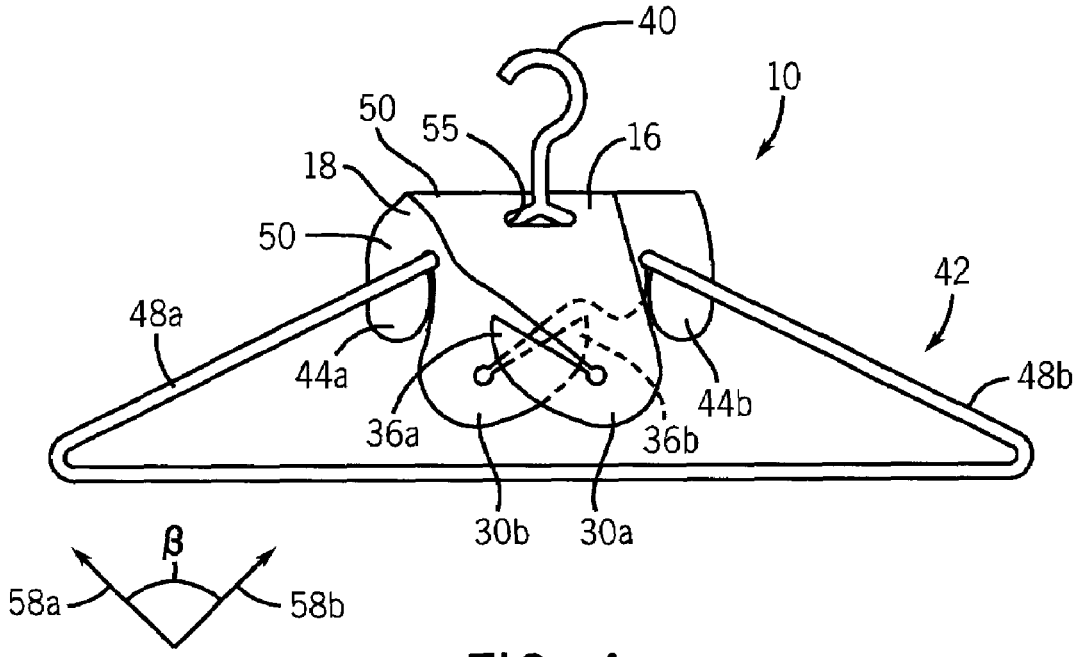
FIG. 4 is a perspective front view of the collar holder of FIG. 3 mounted on a garment hanger.

The collar holder 10 can be used on a conventional wire garment hanger 42. Referring to FIGS. 3-4, in the use of the collar holder 10, the aligned aperture 55, which is an alignment of apertures 38*a*, 38*b*, is placed over the hook 40 of a garment hanger 42, and the side flaps 44*a*, 44*b* are positioned over (straddle) the lateral extensions 48*a*, 48*b* of the hanger. The top panel 16 is folded onto the base panel 18, as depicted in a frontal view in FIG. 3 and in rear view in FIG. 4, showing the back surface 56 of the collar holder. As shown, the top panel 16 overlaps the base panel 18, with the end 36*a* of the extension member 30*a* extending in one direction (arrow 58*a*) and the other end 36*b* of the extension member 30*b* extending in an opposite diagonal direction (arrow 58*b*).

Figure 4A:
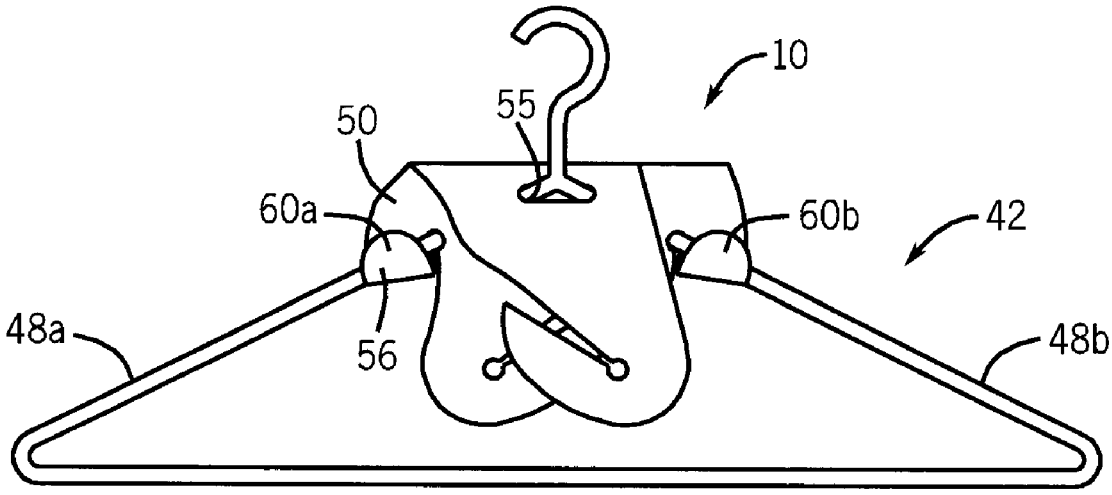
FIG. 4A is a perspective front view of a collar holder formed from the FIG. 2A blank mounted on a garment hanger with the side flaps folded over the lateral extensions and adhered together.
Figure 5:
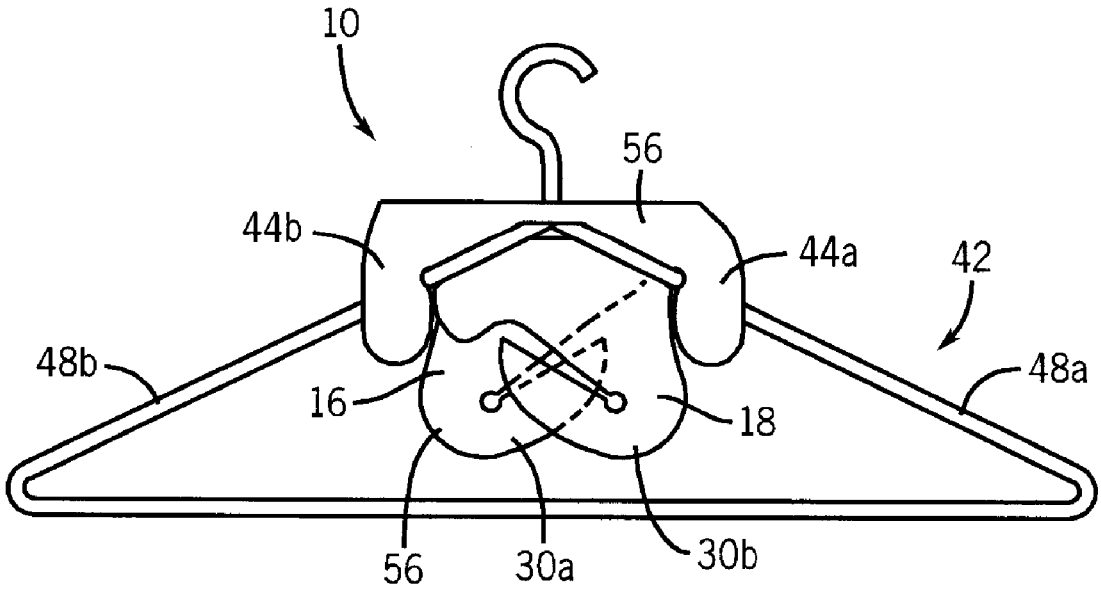
FIG. 5 is a perspective rear view of the collar holder of FIG. 3 mounted on a garment hanger.

In the embodiment of the collar holder 10 (FIG. 2A) in which the side flaps 44*a*, 44*b* include an adhesive coating 51, the backing 53 can be removed and the ends 60*a*, 60*b* of the side flaps can be folded up and around the lateral extensions 48*a*, 48*b* of the hanger, and the adhesive adhered together with pressure to further secure the collar holder in place on the hanger, as depicted in FIG. 4A. In other embodiments that do not incorporate an adhesive element, the ends 60*a*, 60*b* can be secured together by using tape, glue, staples, and other like securing means.

Figure 6:
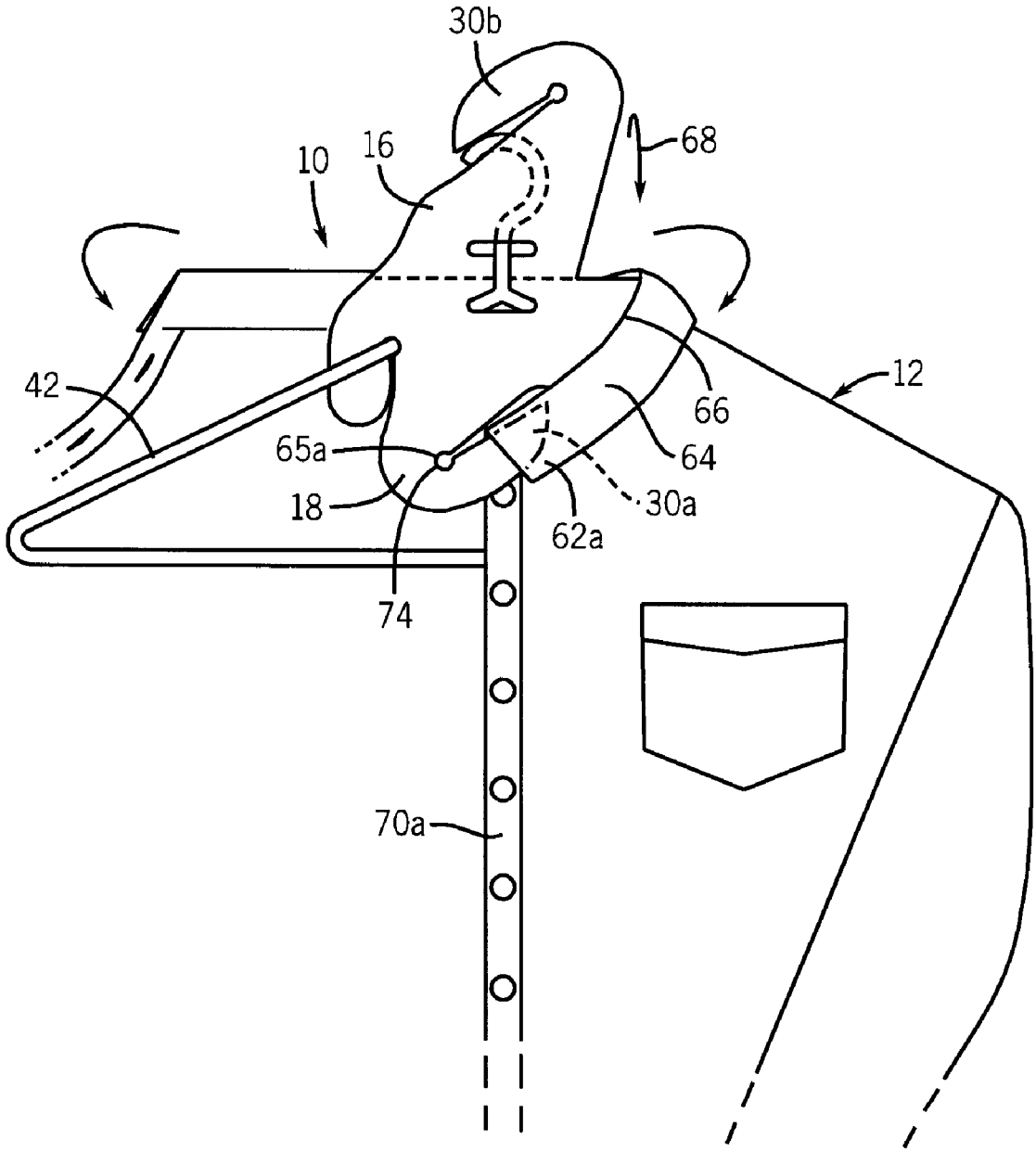
FIG. 6 shows a step of using the collar holder of FIG. 3 in the hanging of a shirt in accordance with the invention.

As shown in FIG. 6, in use, an unbuttoned collared garment, such as a shirt 12, is placed on the hanger 42 and the extension member 30*a* of the base panel 18 is inserted under one of the flaps ("collar wing") 62*a* of the front portion of a collar of the shirt, extending in one direction in line with the seam of the neck line 66. The top panel 16 of the collar holder is folded downwardly (arrow 68) to overlap the collar wing 62*a*, and the extension member 30*b* of the top panel 16 is inserted under the other of the collar wings 62*b* extending in the opposite direction, as shown in FIG. 1.

The extension members 30*a*, 30*b* are adapted (sized and dimensioned) for engagement under the collar wings 62*a*, 62*b* of a collar of an unbuttoned garment mounted on a hanger with the collar wings overlapped in a generally "V" configuration, and the front plackets 70*a*, 70*b* of the garment overlapped and hung in a substantially parallel alignment. The collar holder of the invention holds up the collar and the front plackets such that there are few or no wrinkles (or "buckling") of the front plackets below the collar. The collar holder also provides support to the front of a shirt that will minimize wrinkling while it is hung on a garment hanger.

A blank 14 having dimensions of a length "l" of about 6 to about 6½ inches (about 16 cm) and a width "w" (of base panel 18) of about 5 inches (about 13 cm) is generally suitable for forming a collar holder 10 for a typical adult male shirt. It is appreciated that the dimensions can be varied to accommodate garment sizes having a range of neck (collar) sizes.

Figure 7:
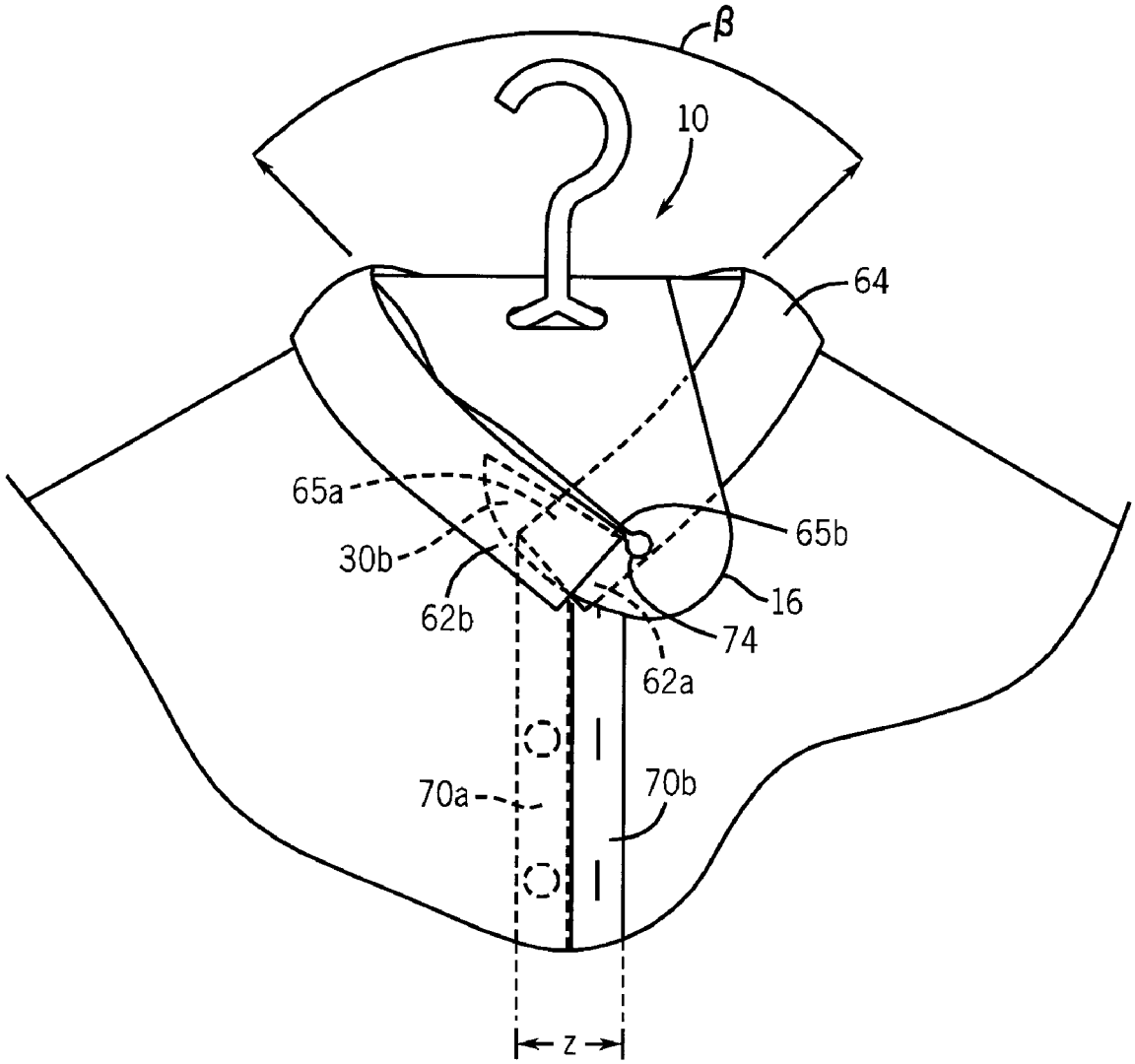
FIG. 7 is a front view of the shirt hanging on a wire garment hanger as shown in FIG. 1, showing the alignment of the front ends (collar wings) of the shirt collar and the front plackets of the shirt.

The extension members 30*a*, 30*b* are elongate and diagonally oriented to provide support to the collar. As illustrated in FIG. 7, the extension members 30*a*, 30*b* hold the collar of the shirt such that the collar wings 62*a*, 62*b* are overlapped at a V-shaped angle (β), and the front plackets 70*a*, 70*b* of the shirt are overlapped or adjacent to each other in an about parallel alignment. Preferably, the corners 65*a*, 65*b* at the neck line 66 of the collar wings 62*a*, 62*b* are overlapped, for example, by about 1½ to about 2½ inches ("z") so as to pull the collar tight around the hanger such that the garment hangs correctly and front portion does not open up. To that end, the extensions members 30*a*, 30*b* are oriented relative to the longitudinal axis 72 of the panel 16, 18, at an acute angle α (FIG. 2), for example, an about 40° to an about 35° angle, and typically at an about 45° angle so that the collar wings 62*a*, 62*b* are supported at V-shaped angle that is an obtuse angle β (FIG. 7), for example, an about 120° angle. In addition, as depicted in FIG. 2, the distance (length "$l_2$") from the aperture 38*a* to the end 74 of the slot 32*a* of the extension member (and from aperture 38*b* to end 74 of slot 32*b*) is generally about 2 inches (about 5 cm). The length "$l_3$" of the extension members 30*a*, 30*b* is preferably about 1½ to about 2 inches (about 4-5 cm).

Figure 8:
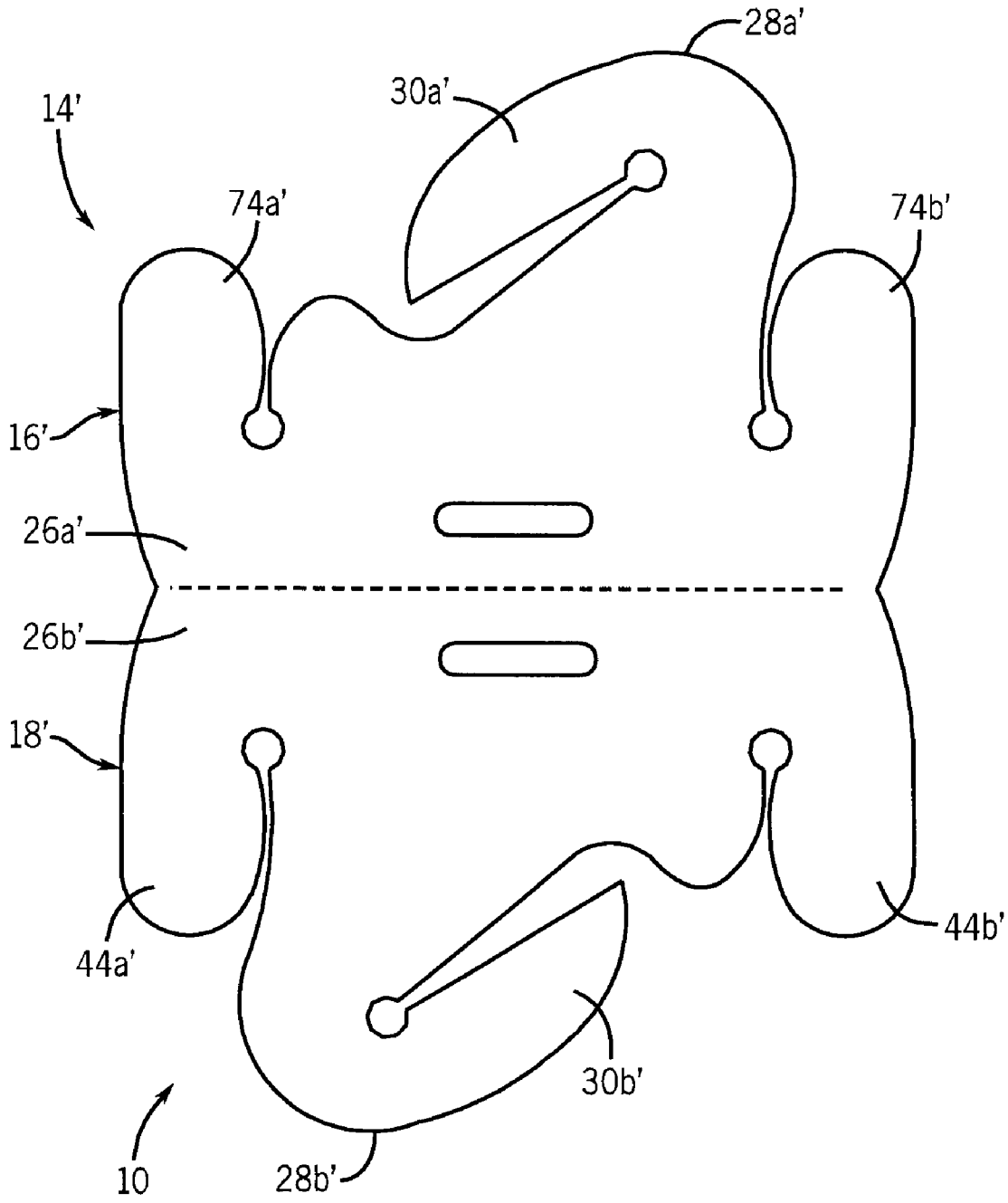
FIG. 8 is a plan view of an integral blank used to form another embodiment of a collar holder according to the invention.

FIG. 8 depicts an integral blank 14' used to form another embodiment of a collar holder 10' according to the invention. The blank 14' includes top and base panels 16', 18', each panel having an extension member 30*a*', 30*b*' at the distal ends 28*a*', 28*b*'. In the present embodiment, both the top and base panels include side flaps for added stability of the collar holder when mounted on a hanger. As shown, base panel 18' includes side flaps 44*a*', 44*b*' as an extension from its base end 26*b*', and top panel 16' includes side flaps 74*a*', 74*b*' extending from its base end 26*a*'. In use, the collar holder 10' is mounted on a hanger such that the side flaps 44*a*', 74*a*' are positioned over one of the lateral extensions (e.g., 48*a*') of the hanger, and the side flaps 44*b*', 74*b*' are placed over the other of the lateral extensions (e.g., 48*b*') of the hanger, similar to the depiction in FIG. 3. If desired, the side flaps 44*a*', 74*a*' and 44*b*', 74*b*' can be secured together by using tape, glue, staples, and other suitable securing means.

Figure 8A:
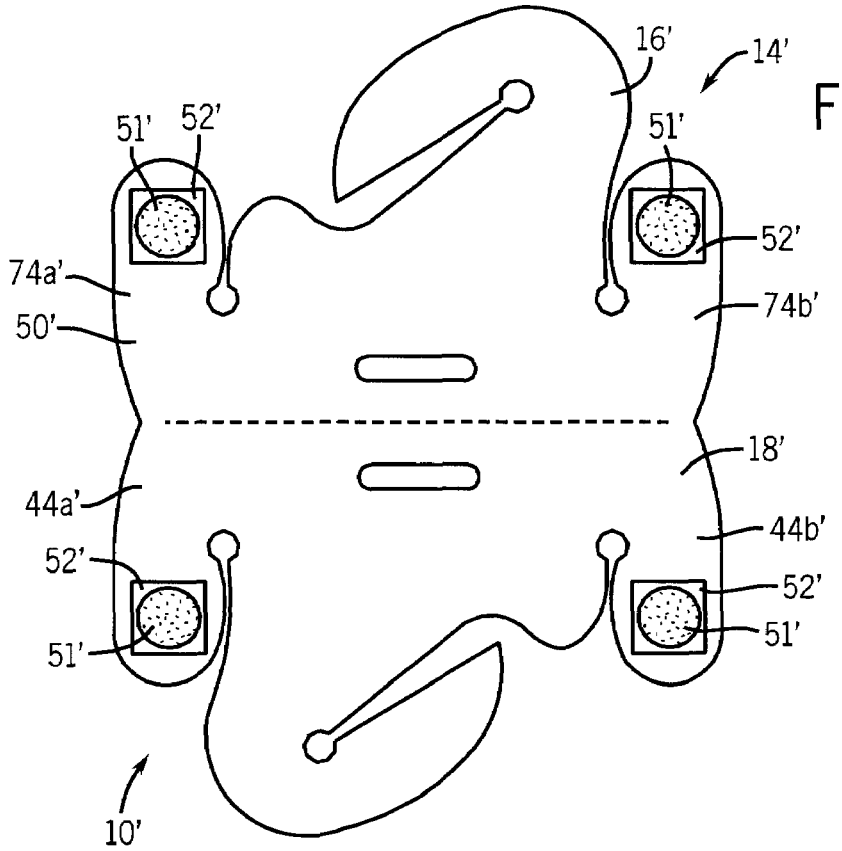
FIG. 8A is a plan view of an embodiment of the FIG. 8 blank having adhesive areas disposed on the front surface of the side flaps of both the top and base panels.
Figure 9:
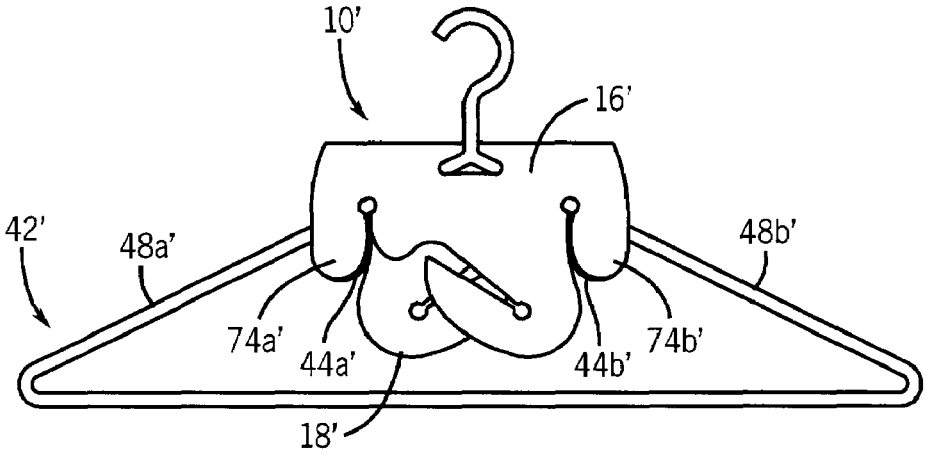
FIG. 9 is a perspective front view of a collar holder formed from the FIG. 8A blank showing one embodiment of mounting the collar holder on a garment hanger with the side flaps positioned on opposite sides of the lateral extensions and adhered together.
Figure 10:
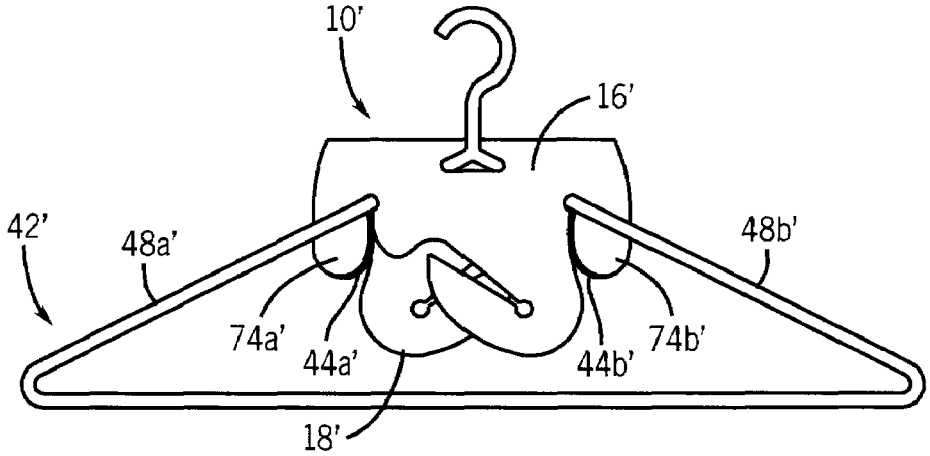
FIG. 10 is a perspective front view of a collar holder formed from the FIG. 8A blank showing another embodiment of mounting the collar holder on a garment hanger with the side flaps mounted over and behind the lateral extensions, and adhered together.

Optionally, adhesive can be applied onto the side flaps as described with respect to FIG. 2A. For example, as depicted in FIG. 8A, the front surfaces 50' of the side flaps 44*a*'>44*b*' and 74*a*', 74*b*' can be coated with a pressure sensitive adhesive in regions 51', which can be covered with a backing 52'. In use, the backing 52' is removed, and the front surfaces 50' of the side flaps can be adhered together around the lateral extensions 48$a'$, 48$b'$ of the hanger, as shown in FIG. 9. In another embodiment, shown in FIG. 10, both of the side flaps 44$a'$, 74$a'$ and 44$b'$, 74$b'$ can be positioned behind the lateral extensions 48$a'$, 48$b'$ of the hanger and adhered together.

Figure 8B:
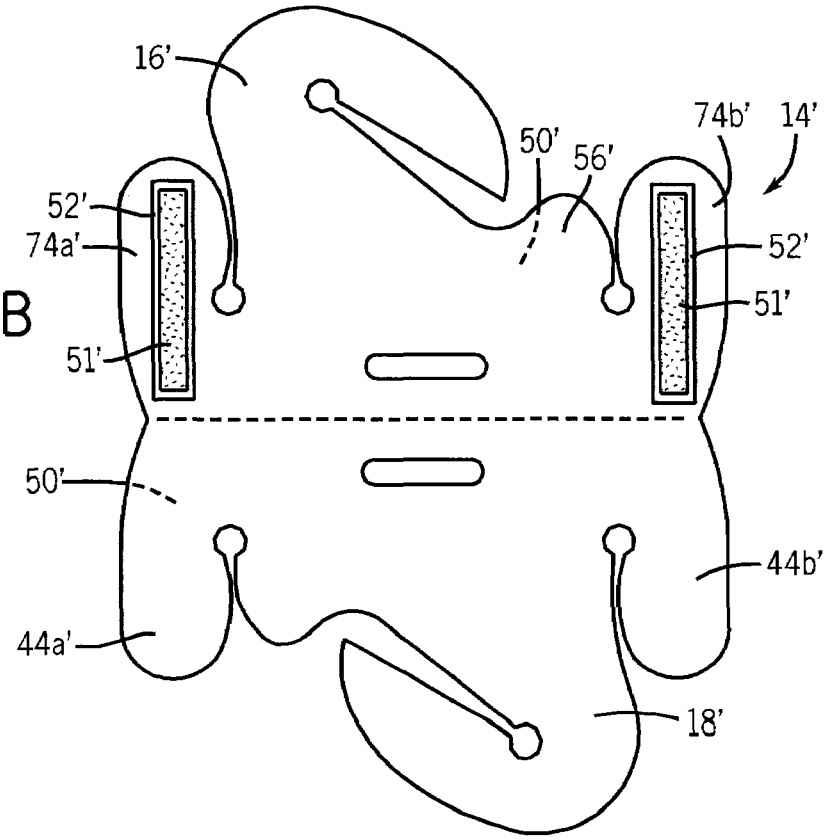
FIG. 8B is a plan view of another embodiment of the FIG. 8 blank having adhesive areas disposed on the back surface of the side flaps of the top panel.
Figure 11:
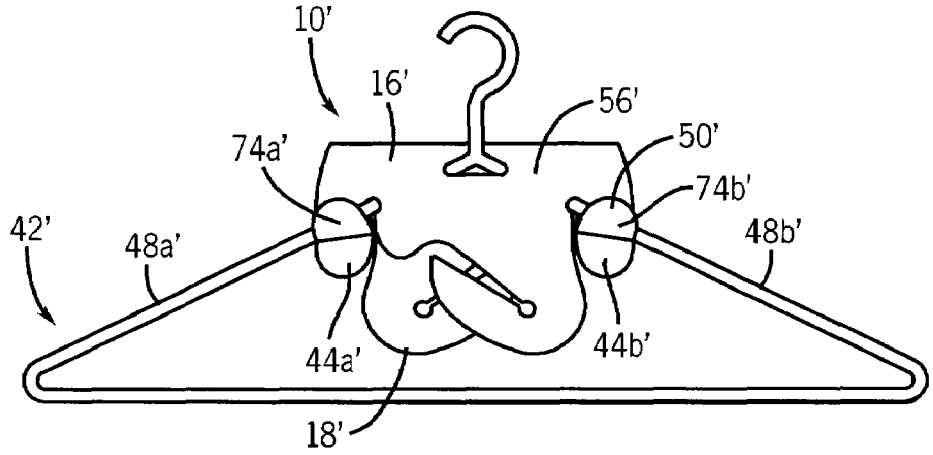
FIG. 11 is a perspective front view of a collar holder formed from the FIG. 8B blank with the side flaps mounted behind the lateral extensions of a garment hanger, and the side flaps of the top panel folded upward and over the lateral extensions and adhered together.

In another example, as depicted in FIG. 8B, adhesive can be applied to the back surface 56' of the side flaps 74$a'$, 74$b'$ of the top panel 16' in area 51' (and covered with a backing 52'). Referring now to FIG. 11, the side flaps 44$a'$, 74$a'$ and 44$b'$, 74$b'$ can be positioned on a hanger behind lateral extensions 48$a'$, 48$b'$. The ends of the side flaps 74$a'$, 74$b'$ can then be folded upward around the lateral extensions, and the adhesive 51 on the side flaps adhered together.

Figure 12:
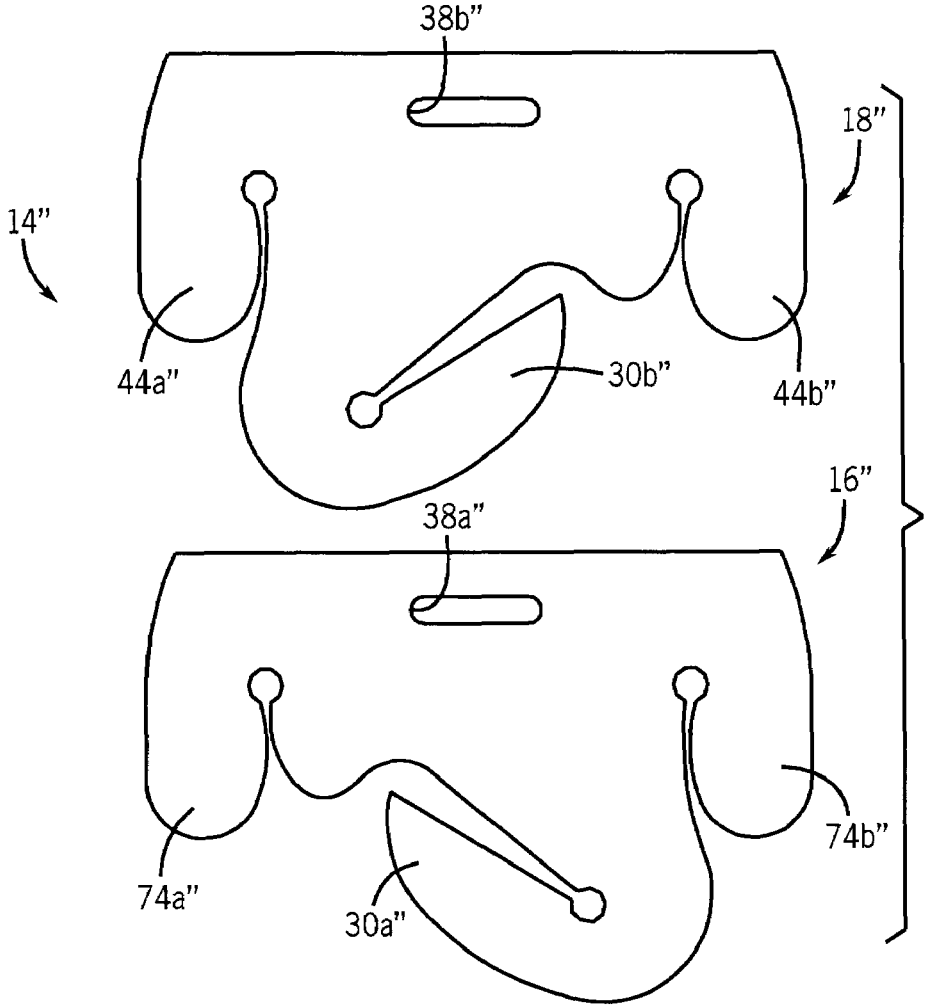
FIG. 12 is a plan view of a blank comprising two separate panels used to form another embodiment of a collar holder according to the invention.
Figure 13:
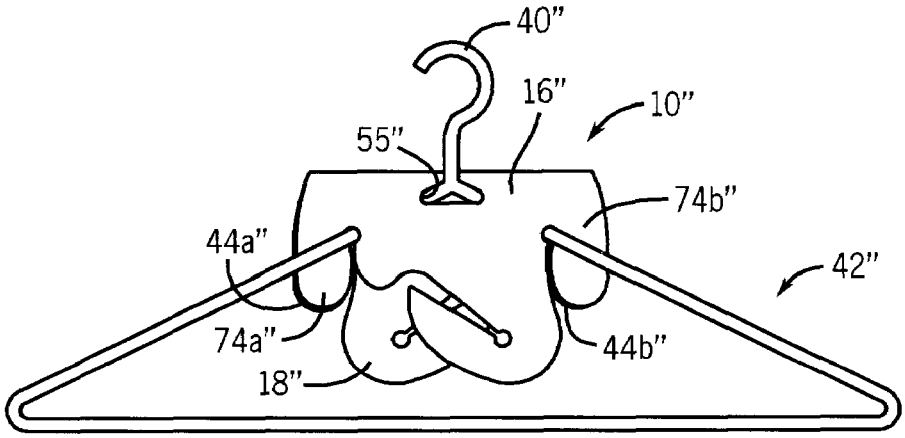
FIG. 13 is a perspective front view of a collar holder formed from the FIG. 12 blank mounted on a garment hanger.

Another embodiment of an integral blank 14" used to form a collar holder 10" according to the invention is depicted in FIG. 12. As illustrated, the blank 14" is composed of two separate panels, a top panel 16" and a base panel 18", which are generally mirror images of each other. Each of the panels has an extension member 30$a''$, 30$b''$ and an aperture 38$a''$, 38$b''$, and includes side flaps 44$a''$, 44$b''$ (base panel) and 74$a''$, 74$b''$ (top panel). The collar holder 10" is secured on a hanger by inserting the hook 40" of the garment hanger 42" through the aperture 38$a''$, 38$b''$ of each of the panels 16", 18", and mounting the side flaps over each of the lateral extensions 48$a''$, 48$b''$ of the hanger, as shown in FIG. 13.

Figure 14:
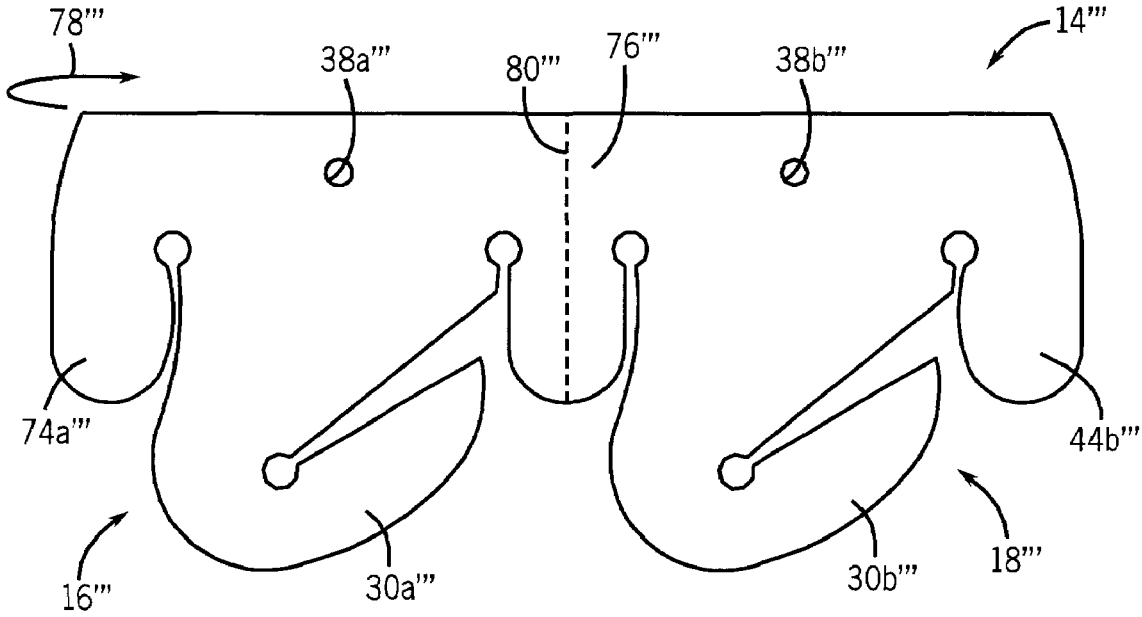
FIG. 14 is a plan view of an integral blank used to form another embodiment of a collar holder according to the invention.
Figure 15:
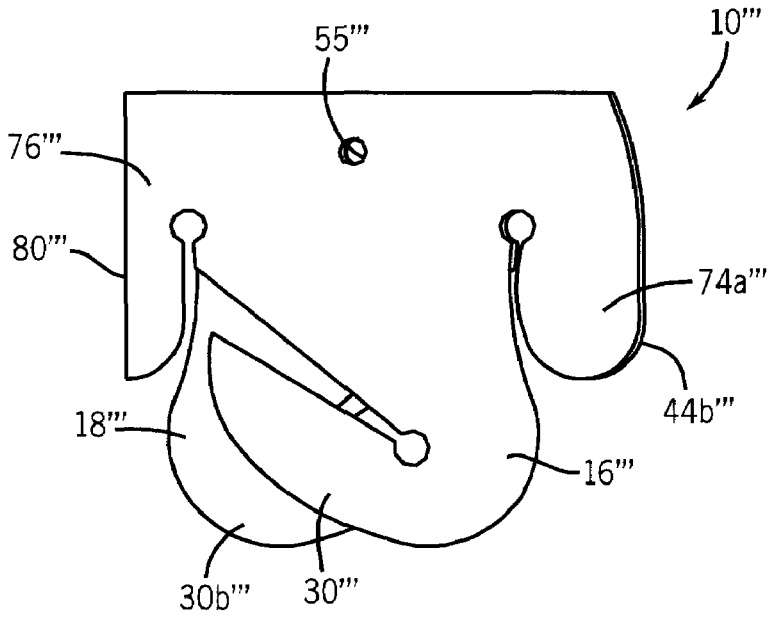
FIG. 15 is a plan view of a collar holder formed from the FIG. 14 blank, which has been folded along the foldline.

Yet another embodiment of an integral blank 14''' used to form a collar holder 10''' according to the invention is depicted in FIGS. 14-15. The blank 14''' is composed of a top panel 16''' and a base panel 18'''. Each panel includes an extension member 30$a'''$, 30$b'''$, and an aperture 38$a'''$, 38$b'''$. In this embodiment, the base panel has a side flap 44$b'''$, the top panel 16''' has a side flap 74$a'''$, and the two panels are joined together by a common side flap 76''' disposed therebetween. In use, the top panel 16''' is folded onto the base panel 18''' (arrow 78'''') along a fold line 80''' in the common side flap 76'''. The collar holder 10''' is mounted on a hanger by inserting the hook of the hanger through the common aperture 55''' of the panels (FIG. 15), and hanging the side flaps 44$a'''$, 74$b'''$ and the common side flap 76''' over the lateral extensions of the hanger.

Figure 16:
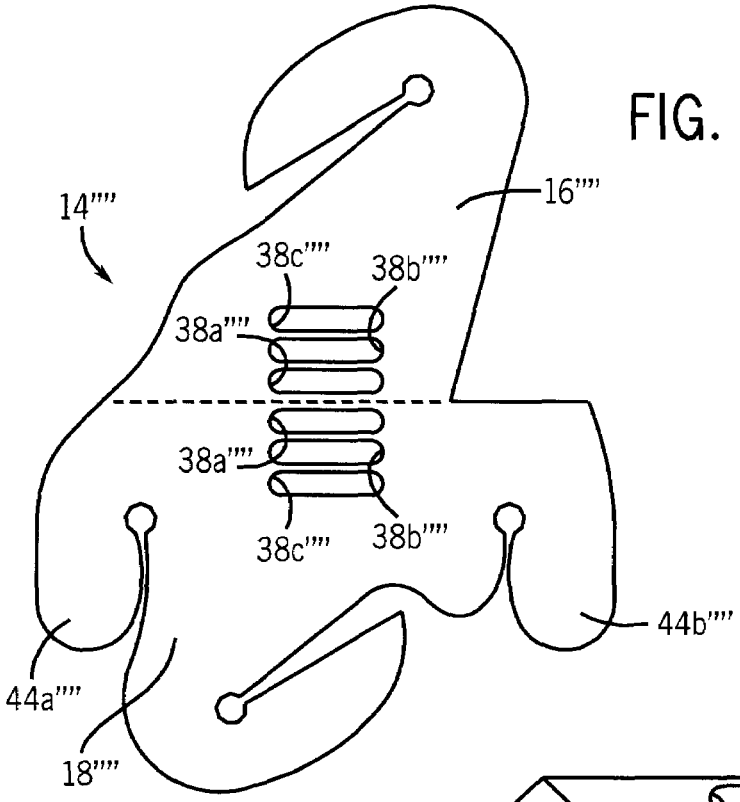
FIG. 16 is a plan view of an embodiment of an integral blank used to form a collar holder that can be hung at different heights on a hanger.
Figure 17:
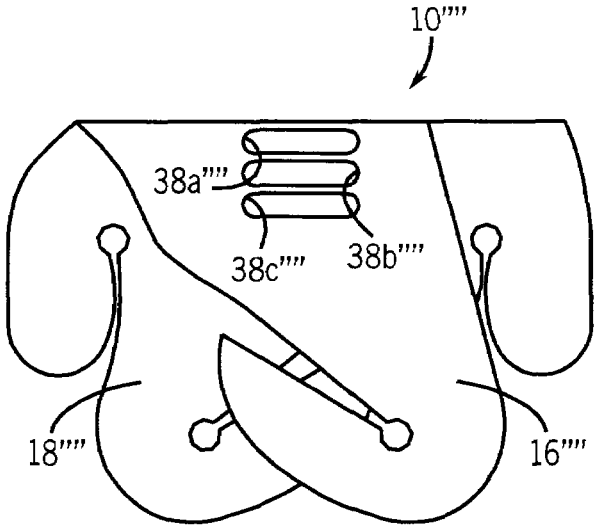
FIGS. 17-18 are perspective views of a collar holder formed from the blank depicted in FIG. 16, with FIG. 18 showing the collar holder mounted on a hanger.
Figure 18:
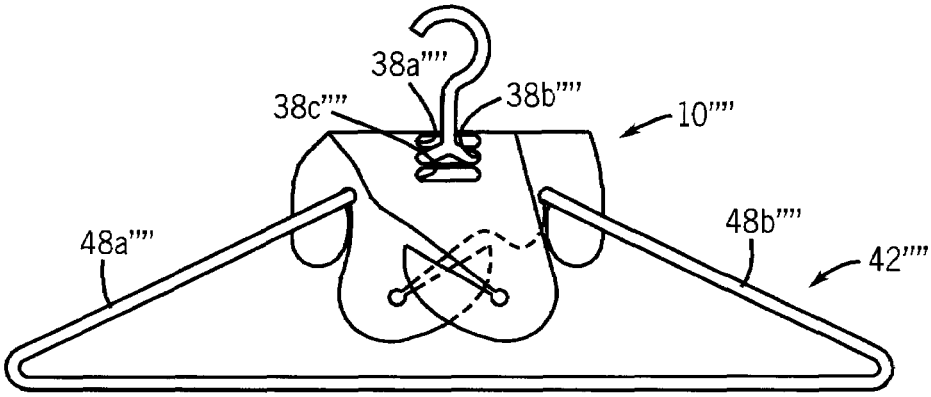

Another embodiment of an integral blank 14'''' for forming a collar holder 10'''' according to the invention is structured to allow a user to attach the holder at different heights on a hanger, which is illustrated in FIGS. 16-18. In place of a single aperture 38 (as shown in FIG. 2), the blank 14'''' has two or more apertures (or slits, slots, etc.), shown as three apertures 38$a''''$, 38$b''''$, 38$c''''$ that are spaced apart in a vertical orientation in each of the top and base panels 16'''', 18''''. The blank 14'''' is folded along a fold line 20'''' such that the corresponding apertures (i.e., 38$a''''$-38$a''''$, 38$b''''$-38$b''''$, 38$c''''$-38$c''''$) line up to form three openings in the collar hold through which the hook in a shirt hanger can be inserted. As shown in FIG. 18, in use, the collar holder 10'''' is passed up and over the hook 40'''' and through one of the apertures, shown here as being inserted through the aperture 38$b''''$. This feature allows the collar holder 10'''' to be positioned higher or lower as desired on the hanger to support the collar close the upper portion or lateral extensions 48$a''''$, 48$b''''$ of the hanger, or lower on the hanger, to achieve maximal support of a shirt and collar and best eliminate gaps and creases.

Figure 19:
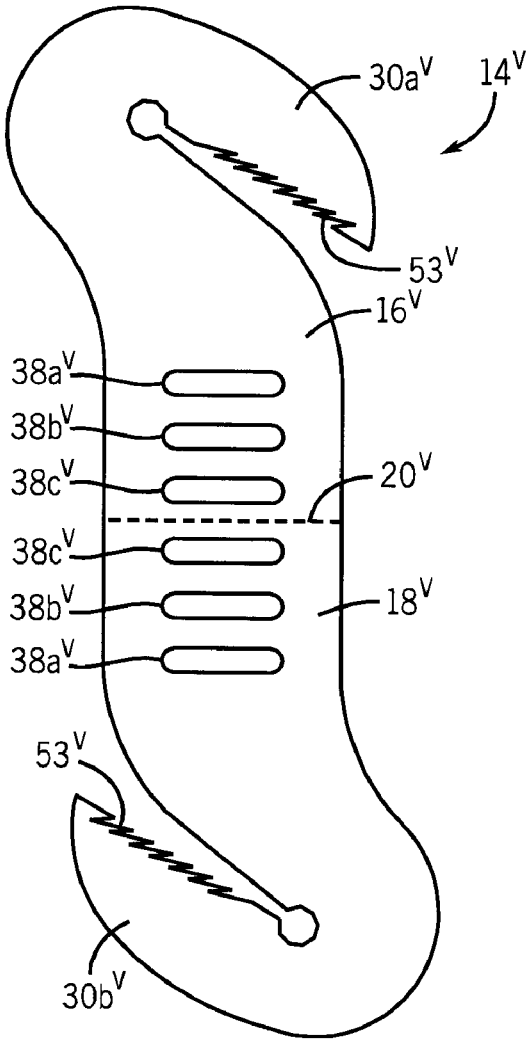
FIGS. 19-21 are plan views of other embodiments of an integral blank for forming a collar holder that can be hung at different heights on a hanger.

As depicted in FIG. 19, in another embodiment, the blank 14$^v$ includes a series of apertures 38$a^v$, 38$b^v$, 38$c^v$ in each of the top and base panels 16$^v$, 18$^v$, the extension members 30$a^v$, 30$b^v$ include a serrated edge 53$^v$ to provide a frictional surface against the garment material to keep the collar wings in position and prevent them from slipping, and the side flaps (44$a''''$, 44$b''''$, as shown in FIG. 16) have been eliminated. The blank 14$^v$ is folded along a fold line 20$^v$ such that the corresponding apertures (i.e., 38$a^v$-38$a^v$, 38$b^v$-38$b^v$, 38$c^v$-38$c^v$) overl form three openings, similar to the embodiment illustrated in FIG. 17, through which the hook of a shirt hanger can be inserted.

Figure 20:
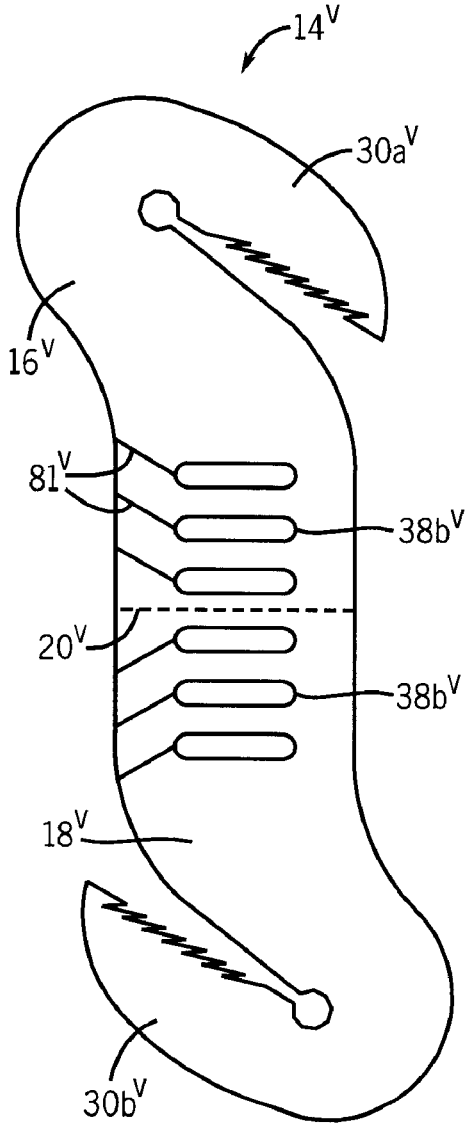

Optionally, as shown in FIG. 20, slits 81$^v$ can be provided to the apertures 38$a^v$, 38$b^v$, 38$c^v$ in each of the top and base panels 16$^v$, 18$^v$. The blank 14$^v$ can folded along the fold line 20$^v$ to form a collar holder 10$^v$, a height for the collar holder on a hanger can be selected, and the hook of the hanger can be slid through and along a slit 81$^v$ and positioned within the desired aperture (e.g., 38$b^v$). In another embodiment, the blank 14$^v$ can be fabricated with a series of apertures (e.g., 38$a^v$, 38$b^v$, 38$c^v$) and a slit 81$^v$ extending to one of the apertures, for example, to the center aperture 38$b^v$, to provide a slit/hole combination.

Figure 21:
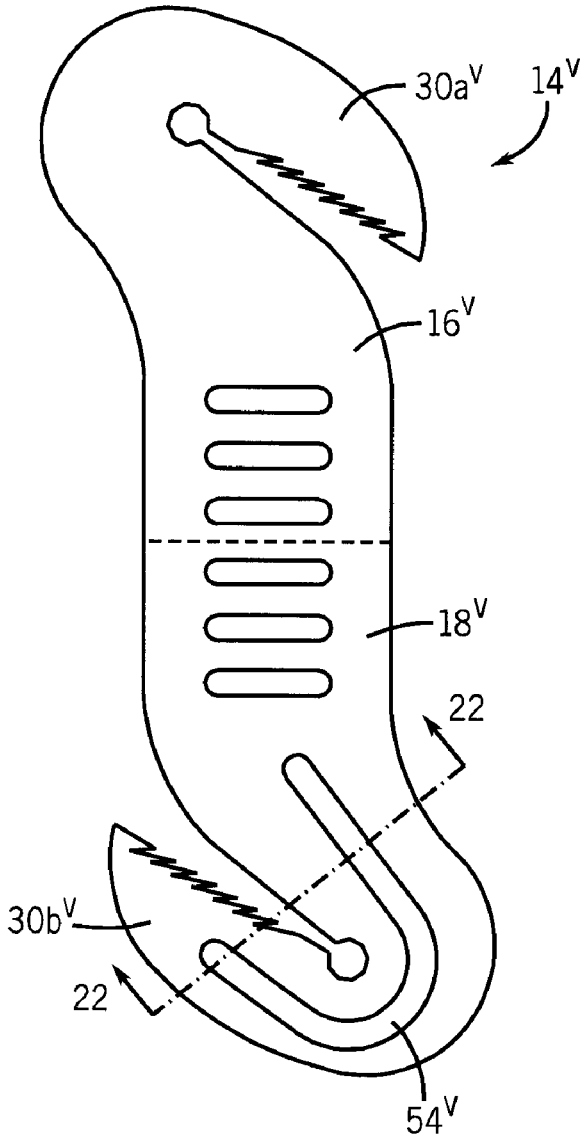
Figure 22:
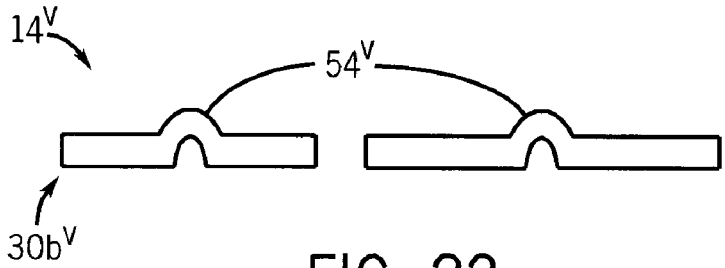
FIG. 22 is a side elevational view of the blank of FIG. 21 taken along line 22-22.
Figure 23:
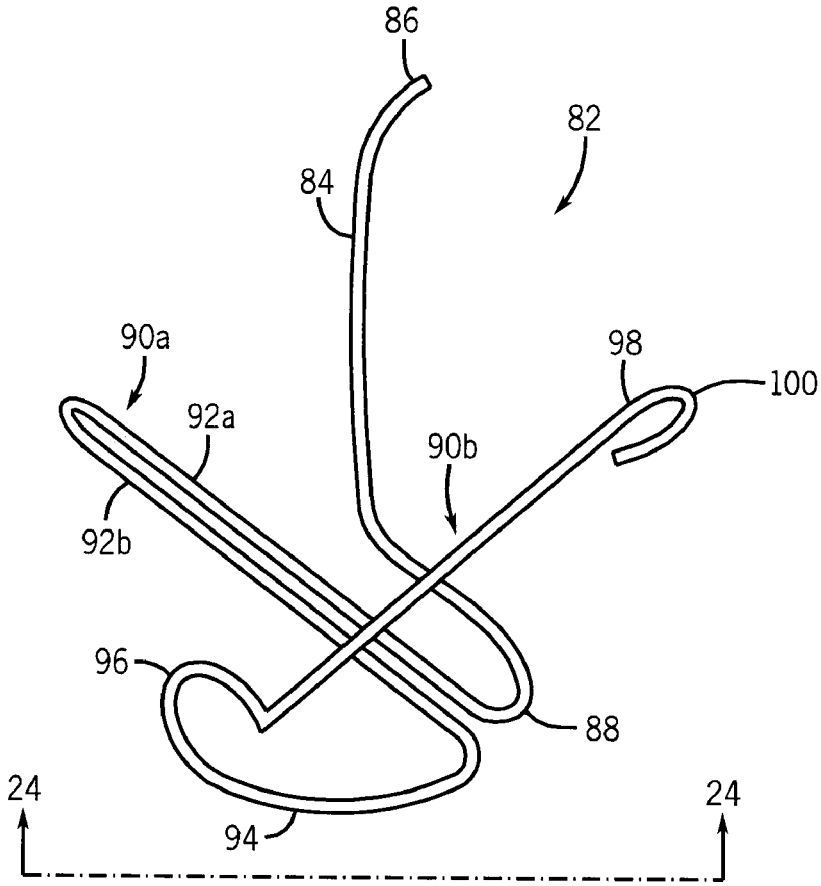
FIGS. 23-28 illustrate an embodiment of the collar holder fabricated from wire.
Figure 24:
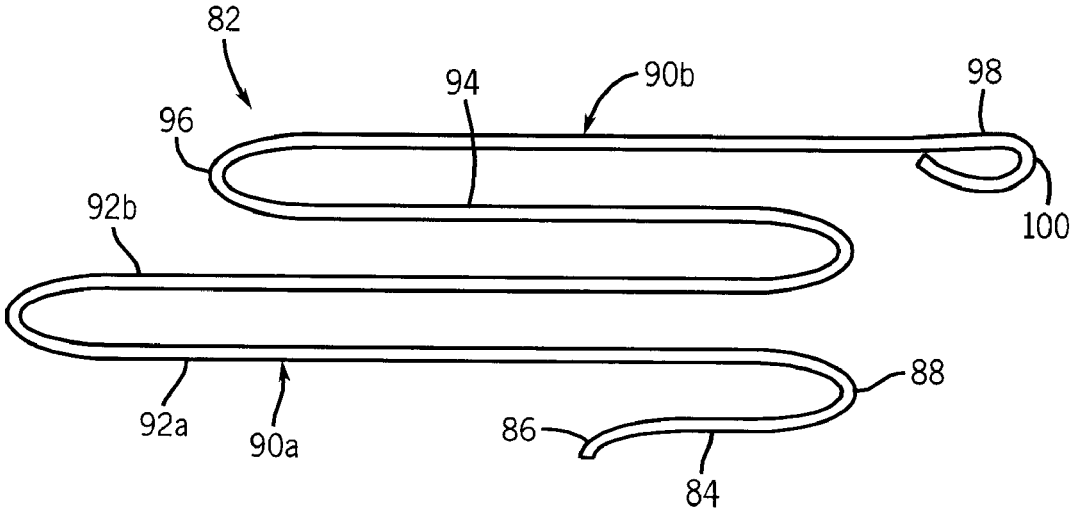

As a further option, as depicted in FIGS. 21-22, the blank 14$^v$ can include a reinforcing element 54$^v$ to strengthen one or both of the extension members 30$a^v$, 30$b^v$ which hold the collar, for example, a raised section or impression formed in the body of the extension member 30$b^v$, as shown.

Figure 25:
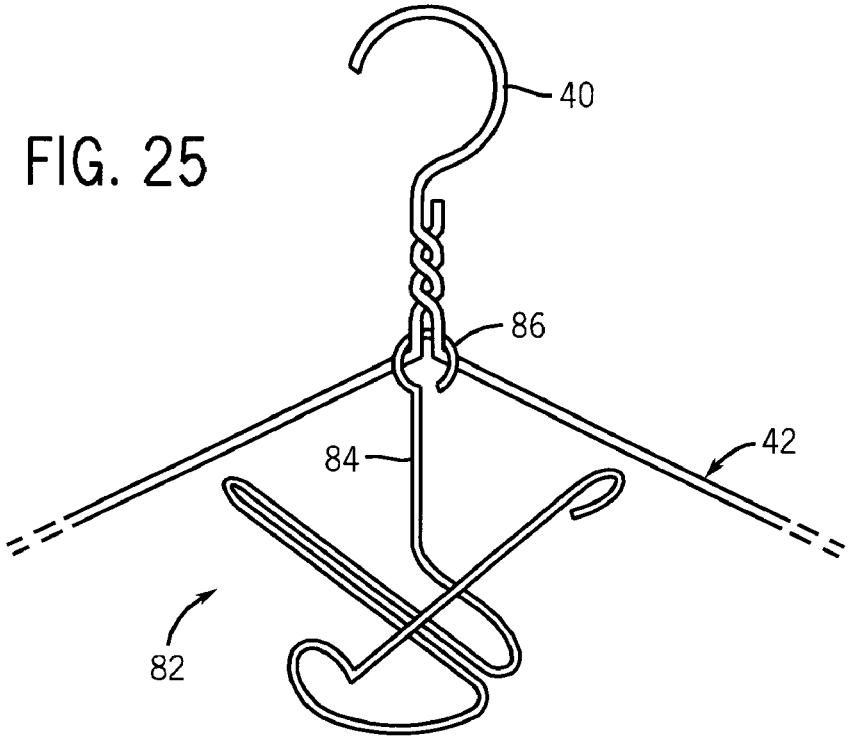
Figure 26:
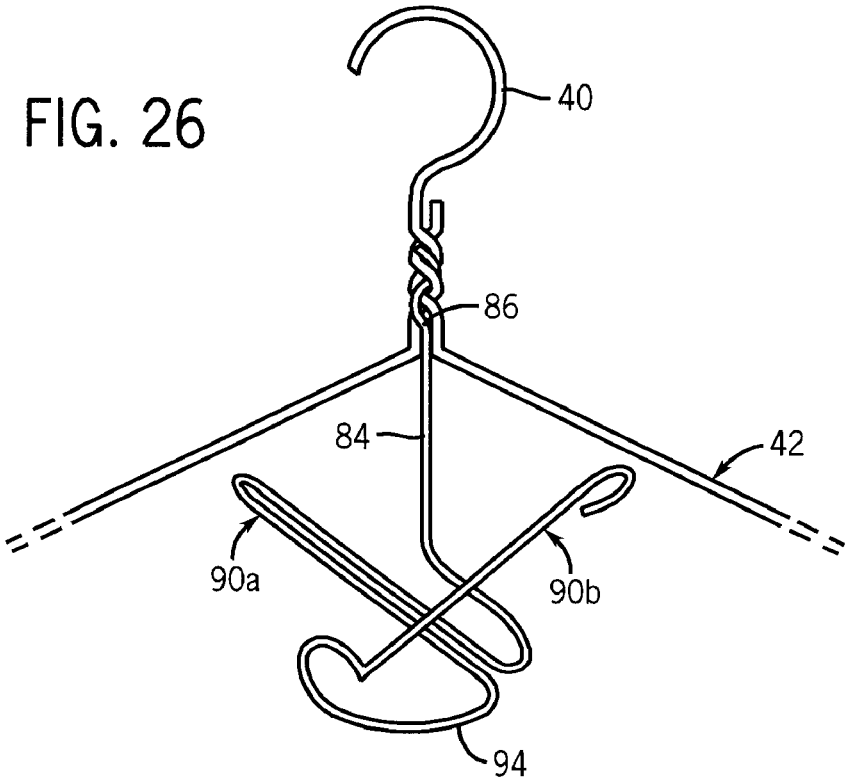

In another embodiment, the collar holding device is composed of wire or other stiff but resilient material (e.g., plastic, etc.) and incorporated into a wire garment hanger, described hereinafter as composed of wire. Referring to FIGS. 23-26, the collar holding device 82 can comprise one or more pieces of wire that are formed as illustrated to include a vertical segment 84 having a first end 86 and a second end that is shaped (bent) to form an angled segment 88 extending into a first angled (finger) extension member 90$a$ having two angled and parallel segments 92$a$, 92$b$. The second angled segment 92$b$ is extended to form a curved base segment 94 that, in turn, is extended and shaped to form an angled segment 96 extending into a second angled (finger) extension member 90$b$. The end 98 of the second angled extension member 90$b$ can be folded or bent back to form a loop as shown so that the end 98 of the wire is directed backwards to provide a rounded forward end 100 that does not puncture the fabric of the garment when the extension member 90$b$ is inserted under the collar. As illustrated in FIG. 25, the collar holding device 82 can be mounted on a garment hanger 42 by forming the end 86 of the vertical segment 84 into a loop, and hanging the looped end 86 over the hook 40 of the garment hanger 42. The device 82 can also be mounted on a garment hanger 42 by joining or twisting the end 86 of the vertical segment 84 about the base of the hook 84 of the hanger 42, as shown in FIG. 26.

Figure 27:
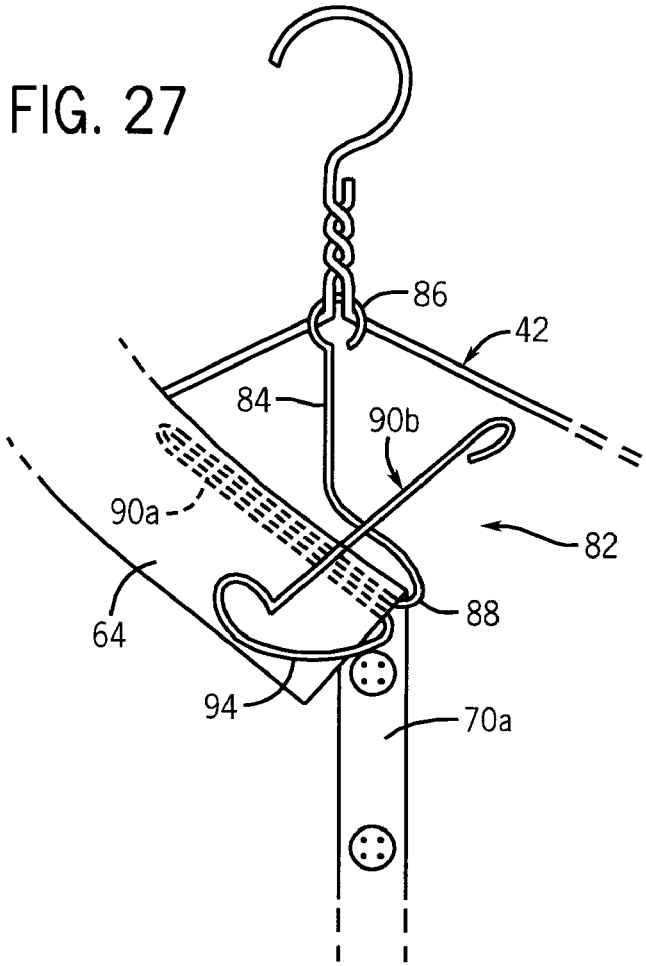
Figure 28:
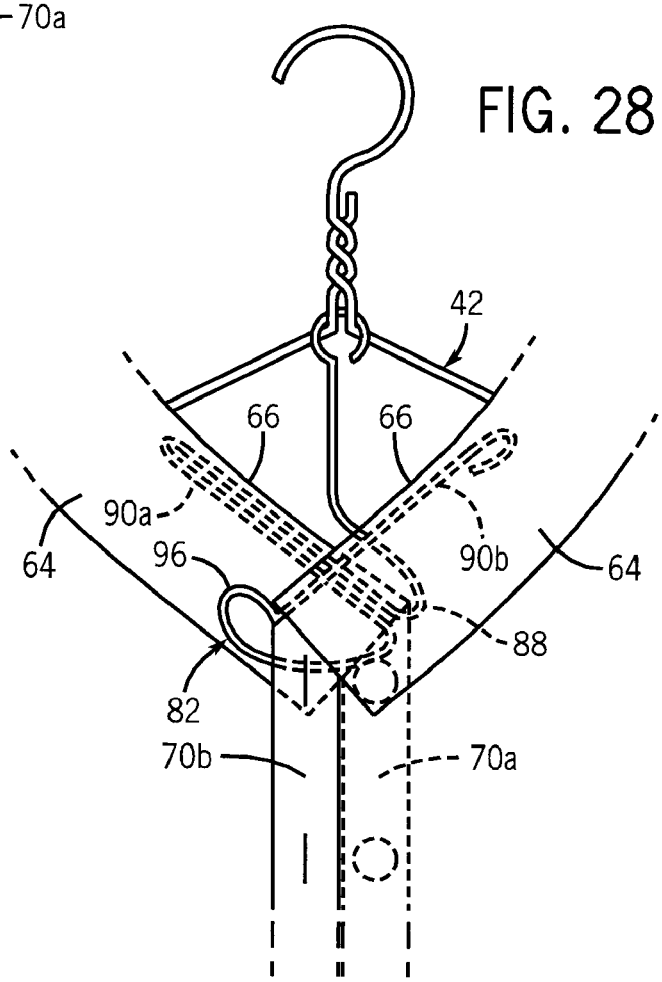

The collar 64 of a garment such as a shirt can be mounted on the collar holding device 82, as illustrated in FIGS. 27-28. As depicted, the first angled extension member 90$a$ is inserted under the collar flap 62$b$ (FIG. 27), and the second angled extension member 90$b$ is inserted under the collar flap 62$a$ (FIG. 28). The angled segment 88 between the vertical segment 84 and the first extension member, the curve of the base segment 94, and the angled segment 98 between the base segment 94 and the second extension member 90$b$, combine to exert a force or tension against the neck edges 66 of the collar 64 to hold the overlapped collar tightly around the hanger 42 such that gaps in the plackets 70$a$, 70$b$ below are substantially eliminated.

Figure 29:
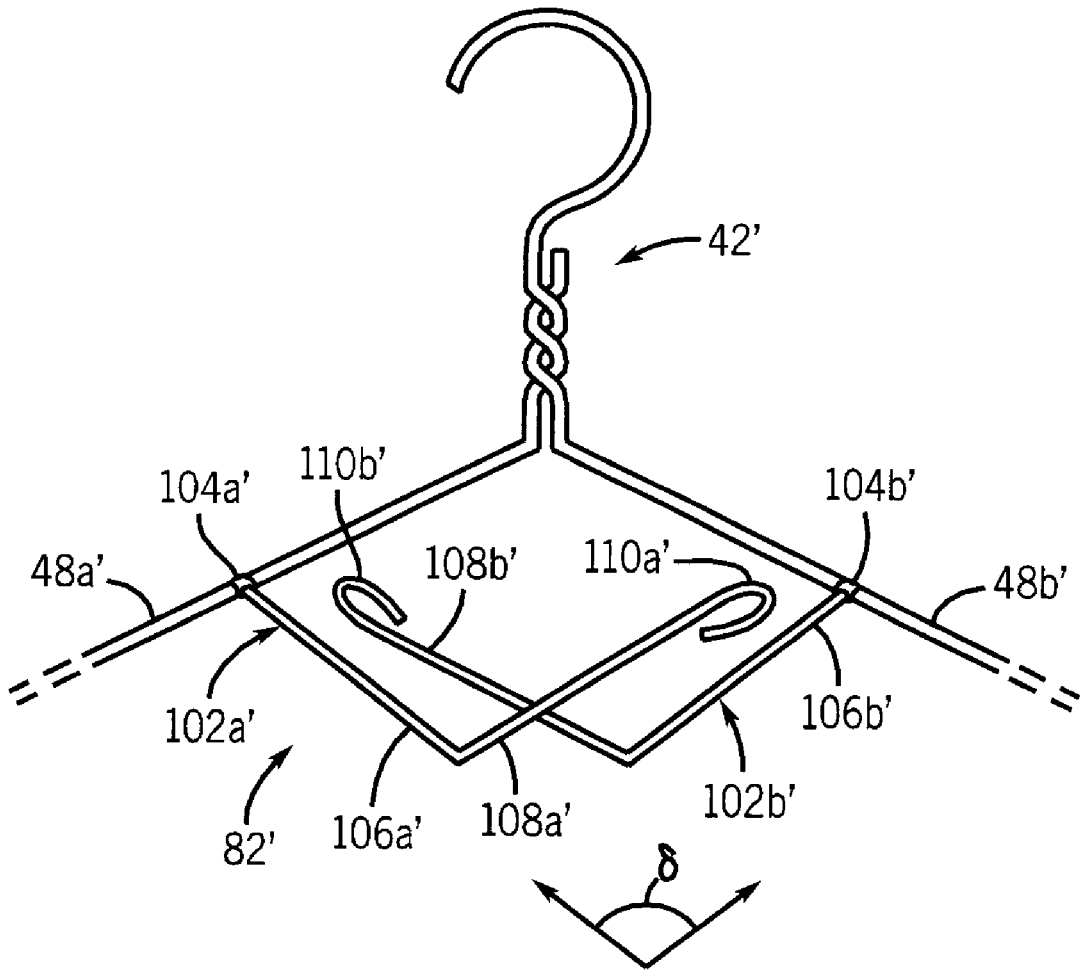
FIGS. 29-33 illustrate additional embodiments of a collar holder of the invention that is formed from wire or other resilient material.

In another embodiment, shown in FIG. 29, the collar holding device 62', advantageously fabricated from wire, is composed of two extension members 102$a'$, 102$b'$, each of which are mounted at one end 104$a'$, 104$b'$ to a lateral extension 48$a$, 48$b$ of a hanger 42, for example, by soldering or other attachment. The extension members 102$a'$, 102$b'$ are bent to form first and second segments 106$a'$/106$b$, 108$a'$/108$b'$ that are at an angle "ϵ", for example, an about 90° to an about 100° angle, with the second (distal) segments 108$a'$, 108$b'$ being crisscrossed. In use, the distal segments 108$a'$, 108$b'$ are inserted under the collar flaps of a garment, similar to the depiction in FIG. 28. The angle ϵ of the bend in the extension members 102*a*', 102*b*' is sufficient to provide the necessary tension against the neck edges (66) of a collar to securely hold the overlapped collar and prevent gaps and wrinkles in the front of the garment. Preferably, the ends 110*a*', 110*b*' of the extension members 102*a*', 102*b*' are looped (as shown) or otherwise rounded to avoid puncturing the garment.

Figure 30:
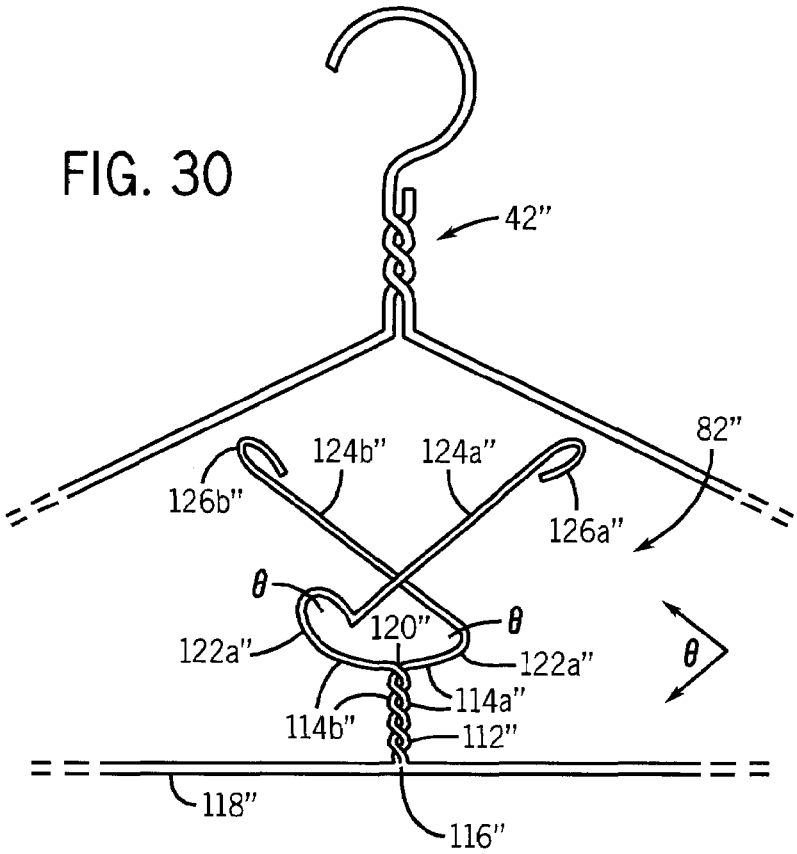

FIG. 30 illustrates a further embodiment of a collar holding device 82", which is preferably fabricated from wire. As shown, the collar holding device 82" is fabricated by a vertically oriented element 112" composed of at least two wire segments 114*a*", 114*b*" that are twisted together and mounted at one end 116" to the horizontal base portion 118" of the hanger 42". At the other end 120" of the twisted vertical element 112", the wire segments 114*a*", 114*b*" separate and extend at opposing angles, and are bent at an angle θ, for example, an about 45° to an about 60° angle, so as to form a curved segment 122*a*", 122*b*" and an extension member 124*a*", 124*b*", which are crisscrossed. The ends 126*a*", 126*b*" can looped or rounded as shown. In use, the extension member 124*a*", 124*b*" are inserted under the collar wings/flaps, similar to that shown in FIG. 28. The angle θ of the bend in the wire segments 114*a*", 14*b*" is sufficient to provide the requisite tension of the extension members 124*a*", 124*b*" against the neck edges (66) of a collar to maintain the overlapping collars and garment plackets without gaps or wrinkling.

Figure 31:
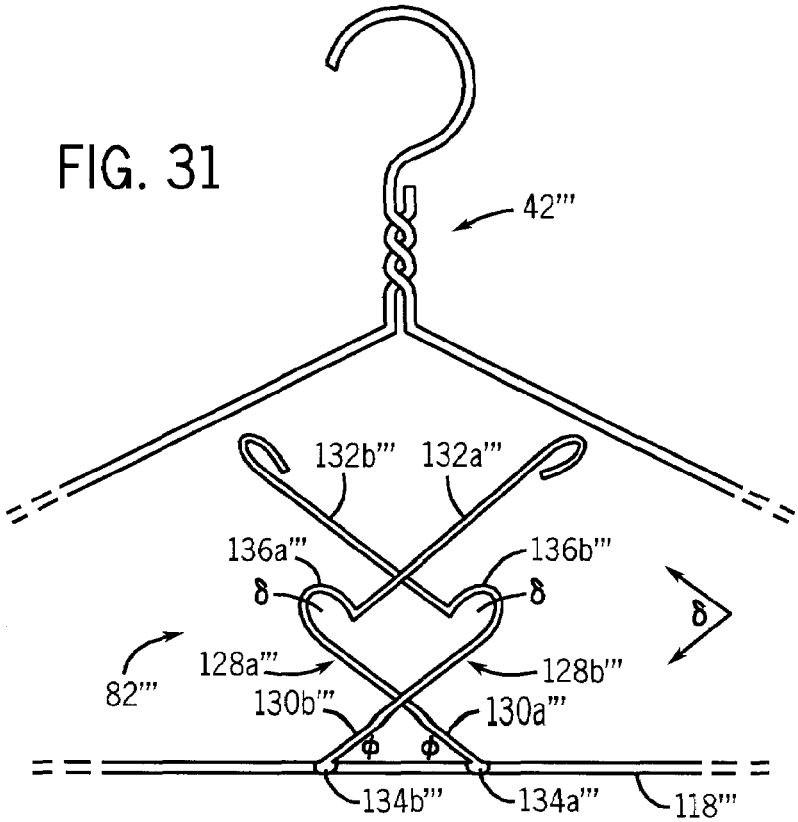

FIG. 31 depicts yet another embodiment of a collar holding device 82'" of the invention, also preferably fabricated from wire. The collar holding device 82'" is formed from two vertically oriented elements 128*a*'", 128*b*'", each of which are bent to form a first segment 130*a*'", 130*b*'", and a second segment 132*a*'", 132*b*'". The ends 134*a*'", 134*b*'" of the first segments 130*a*'", 130*b*'" are mounted to the horizontal base 118'" of the hanger 42'" such that the first segments are oriented at an angle ϕ, for example, an about 50° to about 60° angle, relative to the base 188'" of the hanger and crisscross over each other. The second segments 132*a*'", 132*b*' also crisscross over each other. The angle δ of the bent segments 136*a*'", 136*b*'" can be, for example, an about 50° to about 60° angle. The bent segments 136*a*'", 136*b*'" can include a looped portion as shown, which advantageously increases the tension that is applied by the second segments 132*a*'", 132*b*" against the neck of a collar mounted on the holding device 64'" to hold the collar tightly overlapped.

Figure 32:
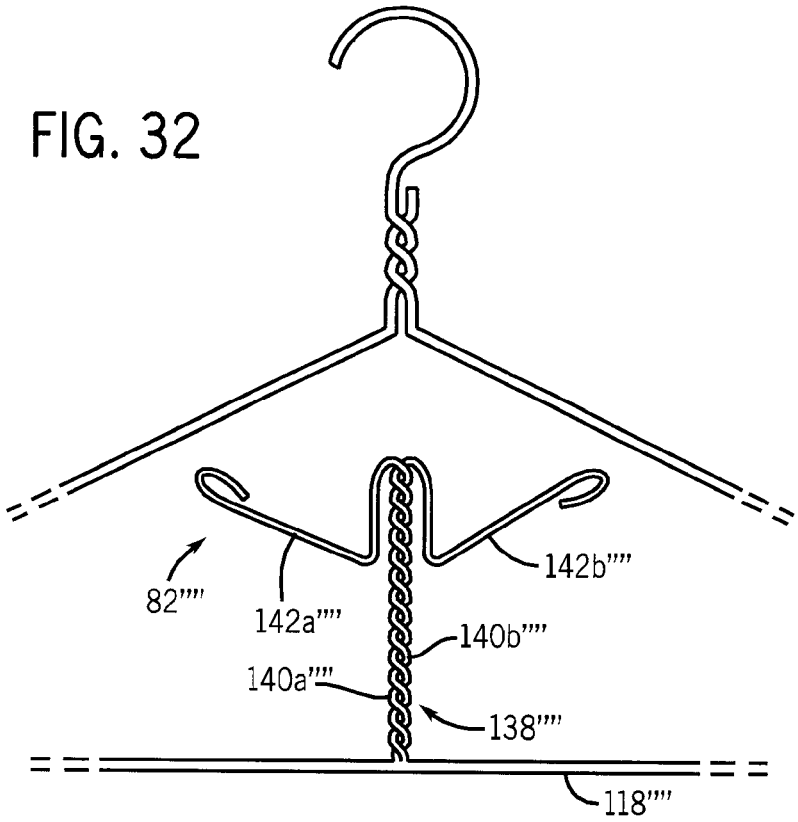
Figure 33:
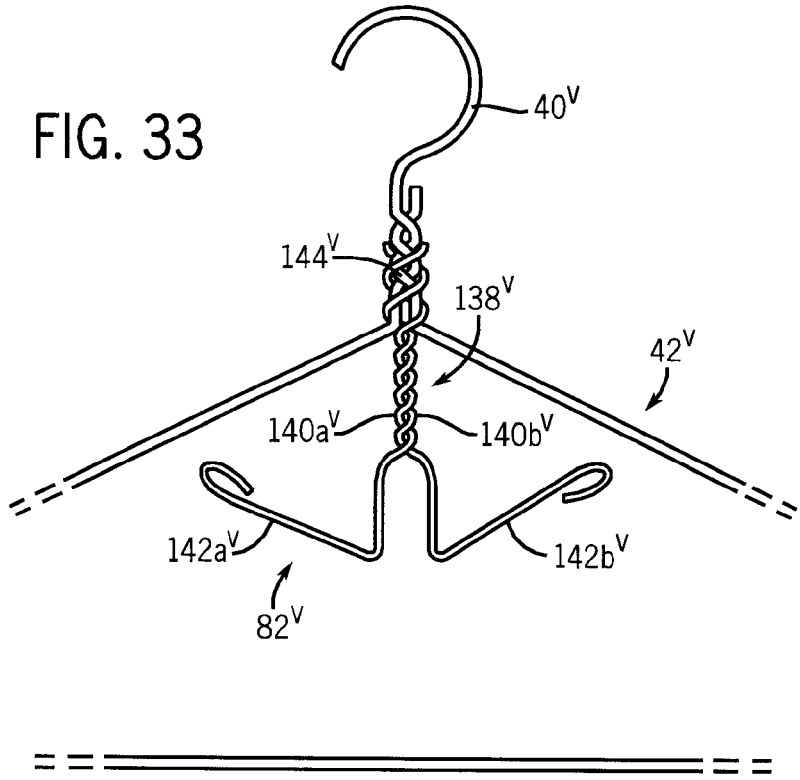

Another embodiment of a collar holder that is fabricated as part of the hanger itself is illustrated in FIGS. 32-33. The collar holder 82'" is formed as a vertically oriented element 138"" composed of two intertwined segments 140*a*"", 140*b*"", which are mounted to the horizontal base portion 118"" of the hanger curved extensions 142*a*"", 142*b*"", which are oriented in opposing directions. A shirt hung on the hanger 42 is positioned such that the curved extensions 142*a*"", 142*b*"" are inserted in line with the seam of the neckline under the flaps (wings) of the collar similar to the use of collar holder 82 (FIG. 28), such that the flaps are overlapped in an about parallel alignment.

In the embodiment shown in FIG. 33, the collar holder 82$^{v}$ is integral to the hook 40 of the hanger 42, either hung from or incorporated into the hook 40. As shown, an end 144$^{v}$ of the vertical element 138$^{v}$ formed by intertwined segments 140*a*$^{v}$, 140*b*$^{v}$, is twisted about the base of the hook 40. The collar holder 82$^{v}$ can include a loop similar to the looped end 86 of collar holder 82 (FIG. 25), which is hung over and secured to the hanger at the base of the hook 40. The two intertwined segments 140*a*$^{v}$, 140*b*$^{v}$ of the vertically oriented element 138$^{v}$ diverge to form curved extensions 142*a*$^{v}$, 142*b*$^{v}$, which are oriented in opposite directions (similar to collar holder 82'"). The curved extensions 142*a*$^{v}$, 142*b*$^{v}$ are inserted in line with the seam of neckline of a shirt hung on the hanger 42 under the flaps of the collar (FIG. 28), with the collar flaps overlapping so as to eliminate gaps in the front panels of the shirt and creases in the front portion of the shirt.

The foregoing collar holders hold a collar up and in an overlapping arrangement to maintain a wrinkle-less shirt-front.

The invention has been described by reference to detailed examples and methodologies. These examples are not meant to limit the scope of the invention. It should be understood that variations and modifications may be made while remaining within the spirit and scope of the invention, and the invention is not to be construed as limited to the specific embodiments disclosed. The disclosures of references cited in the application are incorporated by reference herein.

What is claimed is:

1. A blank for forming a holder for a garment collar, comprising:

a top panel and base panel, each panel comprising a base end having an aperture sized for receiving a hook of a garment hanger therethrough and a distal end comprising an extension member, wherein the base ends of said panels are superimposed with the apertures aligned and the extension members oriented in opposite diagonal directions to form the collar holder; and when the collar holder is mounted on a hook of a garment hanger and a garment having a collar with flaps is mounted on the collar holder with the extension members of the collar holder positioned under the flaps of the collar, the collar flaps are situated in an overlapping arrangement by engagement with the extension members and front plackets of the garment are overlapped and substantially parallel to each other.

2. The blank of claim 1, wherein the top and base panels are foldably connected along a foldline.

3. The blank of claim 2, wherein the top panel and base panel are foldably connected along a length of the base ends.

4. The blank of claim 2, wherein the top panel and base panel are foldably connected along a side edge.

5. The blank of claim 1, wherein at least one of the panels comprises a pair of side flaps integrally attached to the base end and adapted for engagement with the garment hanger to secure the collar holder in a substantially fixed position on the hanger.

6. The blank of claim 5, wherein a surface of the side flaps is coated with a pressure sensitive adhesive material.

7. The blank of claim 1, wherein the base end of each panel comprises a plurality of apertures such that when the top panel is situated over the base panel, the position of the collar holder when mounted on a garment hanger can be altered according to the aperture through which the hook of the hanger is inserted.

8. The blank of claim 1, wherein the top and base panels comprise a stiff, yieldably flexible material selected from the group consisting of cardboard, paperboard, fiberboard, and plastic.

9. The blank of claim 1, wherein the extension members are oriented relative to a longitudinal axis of each panel at an about 40-35° angle.

10. The blank of claim 1, further comprising a reinforcing element integral to at least one extension member.

11. A blank for forming a holder for a collar of a garment, comprising:

a top panel foldably connected to a base panel, each of the top and base panels comprising opposing side edges, a base end comprising an aperture sized for receiving a hook of a garment hanger therethrough, and a distal end comprising an extension defined by a slot extending inwardly at an angle from one side edge toward said distal end, wherein the top panel is folded onto the base panel along the foldline with apertures aligned and the extensions of the top and base panels oriented in opposing diagonal directions to form the collar holder; and when the collar holder is mounted on a hook of a garment hanger and a garment having a collar with flaps is mounted on the collar holder with the extensions of the collar holder positioned under the flaps of the collar, the collar flaps are situated in an overlapping arrangement by engagement with the extensions and front plackets of the garment are overlapped and substantially parallel to each other.

12. A method of hanging a collared garment on a hanger, the garment including the collar having collar flaps and a front having front plackets, the method comprising:

mounting a collar holder onto the garment hanger, the collar holder comprising an element for mounting on a garment hanger and two extension members integral with the mounting element;

mounting the garment on the garment hanger and over the collar holder with the extension members of the collar holder positioned under the collar flaps of the garment wherein the collar flaps are situated in an overlapping arrangement by engagement with the extension members and front plackets of the garment are overlapped and substantially parallel to each other.

13. The method of claim 12, wherein the collar holder comprises a top panel and base panel, each panel comprising a base end bearing the mounting element therein, the mounting element comprising at least one aperture sized for receiving a hook of the garment hanger therethrough, and further bearing one of the two extension members, such that when the collar holder is mounted on the garment hanger, the top panel is situated over the base panel the apertures are aligned and the extension members are oriented in opposite diagonal directions.

14. The method of claim 12, wherein the collar holder comprises wire with an end structured as the mounting element, a vertical segment extending from the mounting element, and each extension member comprising an angled segment integral with the vertical segment.

15. The method of claim 14, wherein the mounting element, vertical segment and extension members are structured from a unitary wire.

16. The method of claim 14, wherein the mounting element comprises a looped end of the wire.

17. The method of claim 14, wherein the mounting element is attached to a horizontal base portion of the hanger.

18. The method of claim 14, wherein the vertical segment comprises at least two wire segments interwined for a length and diverging to form the extension members.

19. The method of claim 12, wherein the collar holder comprises a pair of wires, each having an end structured as the mounting element, and a vertical segment extending from each of the mounting elements, each vertical segment bent to form one of the extension members.

20. The method of claim 19, wherein the vertical segments and the extension members of the collar holder cross over each other when the collar holder is mounted on a garment hanger.

* * * * *